US008171588B2

(12) United States Patent
Chambers et al.

(10) Patent No.: US 8,171,588 B2
(45) Date of Patent: May 8, 2012

(54) PNEUMATIC VALVE ASSEMBLY FOR A PATIENT SUPPORT

(75) Inventors: Kenith W. Chambers, Batesville, IN (US); Bradley T. Wilson, Batesville, IN (US); Reza Hakamiun, Charleston, SC (US); Thomas Uzzle, Mt. Pleasant, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 927 days.

(21) Appl. No.: 12/091,794

(22) PCT Filed: Nov. 9, 2006

(86) PCT No.: PCT/US2006/043801

§ 371 (c)(1), (2), (4) Date: Apr. 28, 2008

(87) PCT Pub. No.: WO2007/056575

PCT Pub. Date: May 18, 2007

(65) Prior Publication Data

US 2008/0282471 A1 Nov. 20, 2008

Related U.S. Application Data

(60) Provisional application No. 60/734,942, filed on Nov. 9, 2005.

(51) Int. Cl.
*A61G 7/00* (2006.01)

(52) U.S. Cl. ..... 5/713; 5/600; 5/710

(58) Field of Classification Search ..... 5/713, 710, 5/655.3, 706, 600, 616
See application file for complete search history.

(56) References Cited

U.S. PATENT DOCUMENTS

| | | | | |
|---|---|---|---|---|
| 2,897,584 | A | | 8/1959 | Schumpelt |
| 4,539,560 | A | * | 9/1985 | Fleck et al. ..... 340/573.4 |
| 5,278,010 | A | * | 1/1994 | Day et al. ..... 430/18 |
| 6,058,537 | A | | 5/2000 | Larson |
| 6,151,739 | A | | 11/2000 | Meyer et al. |
| 6,154,907 | A | * | 12/2000 | Cinquin ..... 5/713 |
| 6,438,776 | B2 | | 8/2002 | Ferrand et al. |
| 6,698,046 | B1 | | 3/2004 | Wu |

FOREIGN PATENT DOCUMENTS

| | | | |
|---|---|---|---|
| EP | 1543748 | A1 | 6/2005 |
| GB | 2 135 089 | A | 8/1984 |
| GB | 2387114 | A | 10/2003 |
| WO | 03/008885 | A | 10/2003 |

OTHER PUBLICATIONS

European Search Report for EP Application Ser. No. 06837334.09-2313, completed Dec. 4, 2008.
PCT International Search Report for PCT/US2006/043801 completed by the US Searching Authority on Sep. 21, 2007.
European Search Report in EP 10 00 4540 dated Jun. 21, 2010 (5 pages).

* cited by examiner

*Primary Examiner* — Fredrick Conley
(74) *Attorney, Agent, or Firm* — Barnes & Thornburg LLP

(57) ABSTRACT

A patient bed including a deck, supported by a base, and a patient support supported by the deck. The patient support includes a pneumatic device and at least one pressure sensor located within the patient support.

24 Claims, 17 Drawing Sheets

PNEUMATIC VALVE ASSEMBLY FOR A PATIENT SUPPORT

CROSS-REFERENCE TO RELATED APPLICATIONS

This application is a U.S. national counterpart application of international application serial No. PCT/US2006/043801 filed Nov. 9, 2006, which claims priority to U.S. Provisional Patent Application No. 60/734,942 filed Nov. 9, 2005. The entire disclosures of PCT/US2006/043801 and U.S. Ser. No. 60/734,942 are hereby incorporated by reference.

The present application is related to U.S. patent application Ser. No. 11/119,980, entitled PRESSURE RELIEF SURFACE, and U.S. patent application Ser. No. 11/119,991, entitled PATIENT SUPPORT HAVING REAL TIME PRESSURE CONTROL, and U.S. patent application Ser. No. 11/119,635, entitled LACK OF PATIENT MOVEMENT MONITOR AND METHOD, and U.S. patent application Ser. No. 11/120,080, entitled PATIENT SUPPORT, all of which were filed on May 2, 2004, all of which are assigned to the assignee of the present disclosure, and all of which are incorporated herein by this reference.

The present application is also related to U.S. Provisional Patent Application Ser. No. 60/636,252, entitled QUICK CONNECTOR FOR MULTIMEDIA, filed Dec. 15, 2004, and U.S. patent application Ser. No. 11/300,667 filed Dec. 13, 2005, which is assigned to the assignee of the present disclosure and incorporated herein by this reference.

The present application is also related to U.S. Provisional Patent Application Ser. No. 60/697,748, entitled PRESSURE CONTROL FOR A HOSPITAL BED, U.S. Provisional Patent Application Ser. No. 60/697,708, entitled CONTROL UNIT FOR A PATIENT SUPPORT, and U.S. Provisional Patent Application Ser. No. 60/697,723, entitled PRESSURE RELIEF SUPPORT SURFACE, all of which were filed on Jul. 8, 2005, are assigned to the assignee of the present disclosure, and are incorporated herein by this reference.

BACKGROUND

The present disclosure relates to a device for supporting a patient, such as a mattress. In particular, the present disclosure relates to patient supports appropriate for use in hospitals, acute care facilities, and other clinical or patient care environments, including homecare. Additionally, the present disclosure relates to a pneumatic valve assembly for a patient support.

Exemplary patient supports are disclosed in, for example, U.S. Pat. No. 5,630,238 to Weismiller et al., U.S. Pat. No. 5,715,548 to Weismiller et al., U.S. Pat. No. 6,076,208 to Heimbrock et al., U.S. Pat. No. 6,240,584 to Perez et al., U.S. Pat. No. 6,320,510 to Menkedick et al., U.S. Pat. No. 6,378,152 to Washburn et al., and U.S. Pat. No. 6,499,167 to Ellis et al., all of which are owned by the assignee of the present disclosure and all of which are incorporated herein by this reference.

SUMMARY

According to one embodiment disclosed herein, a patient support is provided including a cover, a support, a control unit, and a tape switch. The cover defines an interior region. The support is positioned in the interior region. The support has at least a head portion, a seat portion, and a foot portion. The control unit is coupled to the support. The tape switch is located within the interior region and is actuatable by the weight of at least a portion of a patient. The switch is coupled to the control unit to send a signal to the control unit based on actuation of the switch.

According to another embodiment discussed herein, a patient support is provided, including a cover, a support, a pneumatic device, and a pressure sensor. The cover defines an interior region. The support has at least one bladder and is positioned in the interior region. The base has at least a head section and a foot section. The pneumatic device is located within the interior region and is positioned in the foot section. The pneumatic device includes a valve block and a control board. The pressure sensor is located within the interior region. The pressure sensor is actuatable by the weight of at least a portion of a patient. The pressure sensor is coupled to the control unit to send a signal to the control unit based on the actuation of the pressure sensor.

According to yet another embodiment disclosed herein, a method of detecting a position of a patient relative to a patient support is provided. The method includes the steps of: detecting a force, sending a signal, processing the signal, and activating a function. The detecting step includes detecting a force applied to a leg portion of a patient support, the leg portion of the patient support including the tape switch. The sending step includes sending a signal representative of the detected force from the tape switch to the controller. The processing step includes processing the signal at the controller. The activating step includes activating a function of the patient support in response to the signal.

Additional features and aspects of the present invention will become apparent to those skilled in the art upon consideration of the following description and drawings.

BRIEF DESCRIPTION OF THE DRAWINGS

The following figures illustrate exemplary embodiments of the present invention.

DETAILED DESCRIPTION

Figure 1:
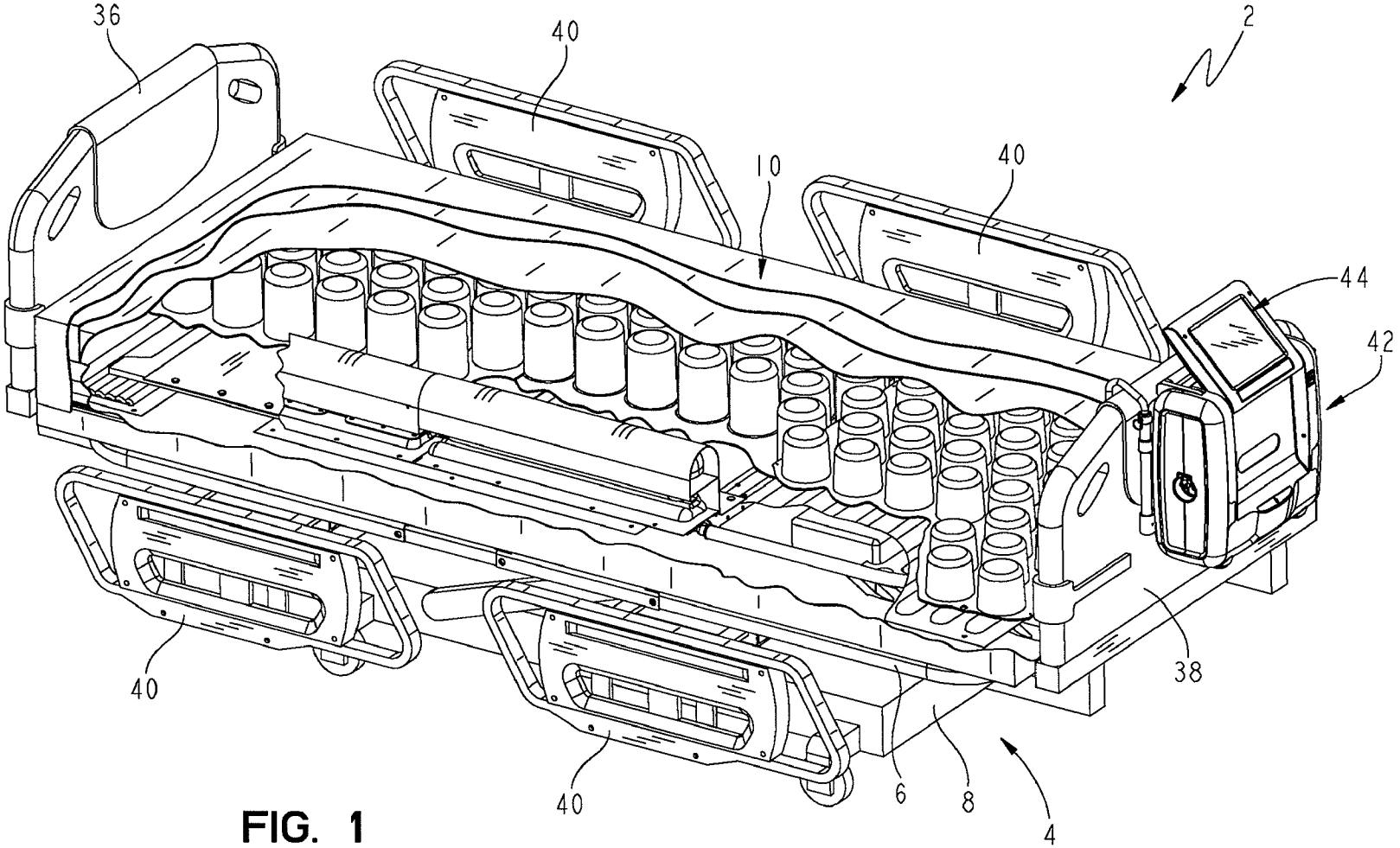
FIG. 1 is a perspective view of a patient support positioned on an exemplary hospital bed, with a portion of the patient support being cut away to show interior components of the patient support.

FIG. 1 shows an embodiment of a patient support or mattress 10 in accordance with the present disclosure. Patient support 10 is positioned on an exemplary bed 2. Bed 2, as illustrated, is a hospital bed including a frame 4, a headboard 36, a footboard 38, and a plurality of siderails 40.

Frame 4 of the exemplary bed 2 generally includes a deck 6 supported by a base 8. Deck 6 includes one or more deck sections (not shown), some or all of which maybe articulating sections, i.e., pivotable with respect to base 8. In general, patient support 10 is configured to be supported by deck 6.

Patient support 10 has an associated control unit 42, which controls inflation and deflation of certain internal components of patient support 10, among other things. Control unit 42 includes a user interface 44, which enables caregivers, service technicians, and/or service providers to configure patient support 10 according to the needs of a particular patient. For example, support characteristics of patient support 10 may be adjusted according to the size, weight, position, or activity of the patient including exiting the bed. Patient support 10 can accommodate a patient of any size, weight, height or width. It is also within the scope of the present disclosure to accommodate bariatric patients of up to 1000 pounds or more. To accommodate patients of varied sizes, the patient support may include a width of up to 50 inches or more. User interface 44 is password-protected or otherwise designed to prevent access by unauthorized persons.

User interface 44 also enables patient support 10 to be adapted to different bed configurations. For example, deck 6 maybe a flat deck or a step or recessed deck. A caregiver may select the appropriate deck configuration via user interface 44.

Figure 2:
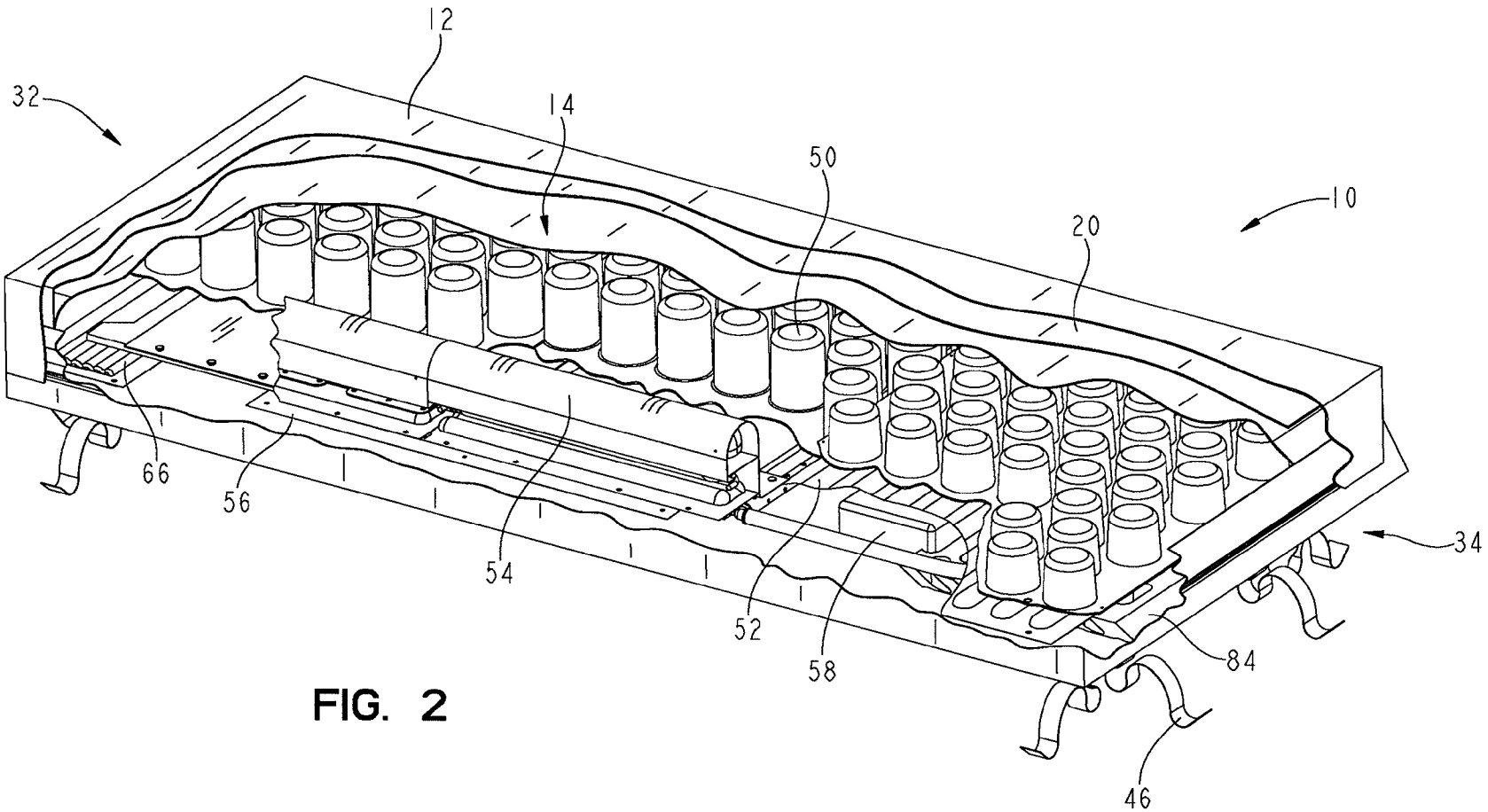
FIG. 2 is a perspective view of a patient support, with a portion being cut away to show interior components of the patient support.

Referring now to FIG. 2, patient support 10 has a head end 32 generally configured to support a patient's head and/or upper body region, and a foot end 34 generally configured to support a patient's feet and/or lower body region. Patient support 10 includes a cover 12 which defines an interior region 14. Within the interior region a support or base is positioned and can include head, seat, and foot portions. In the illustrated embodiment, interior region 14 includes a first layer 20, a second layer 50, and a third layer 52. However, it will be understood by those skilled in the art that other embodiments of the present disclosure may not include all three of these layers, or may include additional layers, without departing from the scope of the present disclosure.

In the illustrated embodiment, first layer 20 includes a support material, second layer 50 includes a plurality of vertically-oriented inflatable bladders located underneath the first layer 20, and third layer 52 includes a plurality of pressure sensors located underneath the vertical bladders of second layer 50, as more particularly described below.

Also located within interior region 14 are a plurality of bolsters 54, one or more filler portions 56, and a pneumatic valve control box, valve box, control box, or pneumatic box 58. A fire-resistant material (not shown) may also be included in the interior region 14.

Patient support 10 may be coupled to deck 6 by one or more couplers 46. Illustratively, couplers 46 are conventional woven or knit or fabric straps including a D-ring or hook and loop assembly or Velcro®-brand strip or similar fastener. It will be understood by those skilled in the art that other suitable couplers, such as buttons, snaps, or tethers may also be used equally as well.

Figure 3:
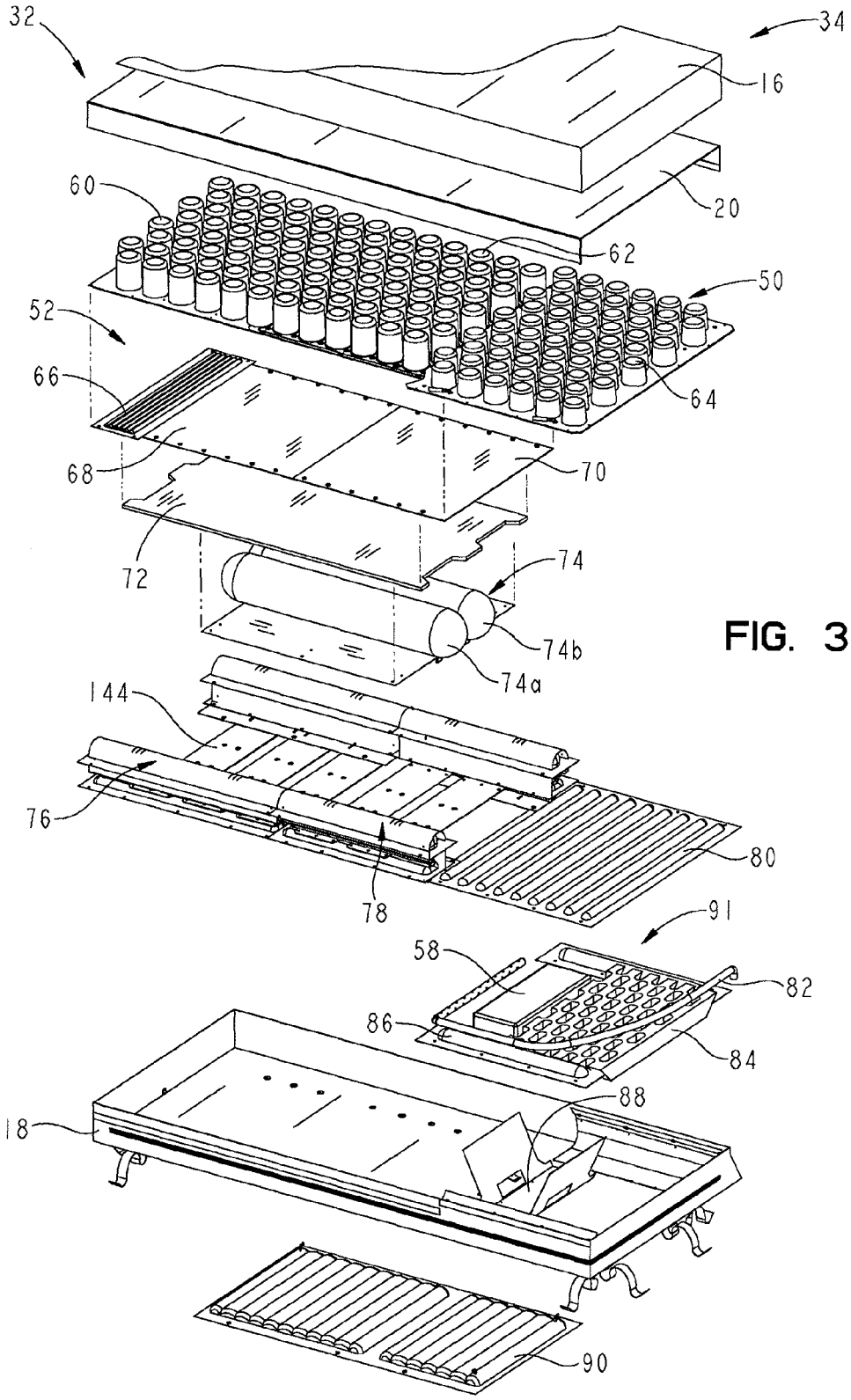
FIG. 3 is an exploded view of components of the illustrated embodiment of a patient support.

Components of one embodiment of a patient support in accordance with the present disclosure are shown in exploded view in FIG. 3. This embodiment of patient support 10 includes a top cover portion 16 and a bottom cover portion 18. Top cover portion 16 and bottom cover portion 18 couple together by conventional means (such as zipper, Velcro® strips, snaps, buttons, or other suitable fastener) to form cover 12, which defines interior region 14. While a plurality of layers and/or components are illustrated within interior region 14, it will be understood by those of skill in the art that the present disclosure does not necessarily require all of the illustrated components to be present.

A first support layer 20 is located below top cover portion 16 in interior region 14. First support layer 20 includes one or more materials, structures, or fabrics suitable for supporting a patient, such as foam, inflatable bladders, or three-dimensional material. Suitable three-dimensional materials include Spacenet, Tytex, and/or similar materials.

Returning to FIG. 3, the second support layer 50 including one or more inflatable bladder assemblies, is located underneath the first support layer 20. The illustrated embodiment of the second support layer 50 includes first, second and third bladder assemblies, namely, a head section bladder assembly 60, a seat section bladder assembly 62, and a foot section bladder assembly 64. However, it will be understood by those skilled in the art that other embodiments include only one bladder assembly extending from head end 32 to foot end 34, or other arrangements of multiple bladder assemblies, for example, including an additional thigh section bladder assembly. In general, bladder assemblies disclosed herein are formed from a lightweight, flexible air-impermeable material such as a polymeric material like polyurethane, urethane-coated fabric, vinyl, or rubber.

A pressure-sensing layer 52 illustratively including first and second sensor pads, namely a head sensor pad 68 and a seat sensor pad 70, is positioned underneath bladder assemblies 60, 62, 64. Head sensor pad 68 is generally aligned underneath head section bladder assembly 60, and seat sensor pad 70 is generally aligned underneath seat section bladder assembly 62, as shown. Head filler 66 maybe positioned adjacent head sensor pad 68 near head end 32 so as to properly position head sensor pad 68 underneath the region of patient support 10 most likely to support the head or upper body section of the patient. In other embodiments, a single sensor pad or additional sensor pads, for example, located underneath foot section bladder assembly 64, and/or different alignments of the sensor pads, are provided. Sensor pads 68, 70 are described with reference to FIGS. 20-21 of U.S. patent application Ser. No. 11/120,080 incorporated herein by this reference.

In the illustrated embodiment, a turn-assist cushion or turning bladder or rotational bladder 74 is located below sensor pads 68, 70. The exemplary turn-assist cushion 74 shown in FIG. 3 includes a pair of inflatable bladders 74*a*, 74*b*. Another suitable rotational bladder 74 is a bellows-shaped bladder. Another suitable turn-assist cushion is disclosed in, for example, U.S. Pat. No. 6,499,167 to Ellis, et al., which patent is owned by the assignee of the present disclosure and incorporated herein by this reference. Turn-assist cushions 74 are not necessarily a required element of the present disclosure.

A plurality of other support components 66, 72, 76, 78, 80, 84, 86, 90 are also provided in the embodiment of FIG. 3. One or more of these support components are provided to enable patient support 10 to be used in connection with a variety of different bed frames, in particular, a variety of bed frames having different deck configurations. One or more of these support components maybe selectively inflated or deflated or added to or removed from patient support 10 in order to conform patient support 10 to a particular deck configuration, such as a step or recessed deck or a flat deck.

The support components illustrated in FIG. 3 are made of foam, inflatable bladders, three-dimensional material, other suitable support material, or a combination of these. For example, as illustrated, head filler 66 includes a plurality of foam ribs extending transversely across patient support 10. Head filler 66 could also be an inflatable bladder. Filler portion 72 includes a foam layer positioned substantially underneath the sensor pads 68, 70 and extending transversely across the patient support 10. In the illustrated embodiment, filler portion 72 includes a very firm foam, such as polyethylene closed-cell foam, with a ½-inch thickness.

Head bolster assembly 76, seat bolster assembly 78, and foot section bolster assembly 86 each include longitudinally-oriented inflatable bladders spaced apart by coupler plates 144.

As illustrated, first foot filler portion 80 includes a plurality of inflatable bladders extending transversely across patient support 10, and second foot filler portion 84 includes a foam member, illustratively with portions cut out to allow for retractability of the foot section or for other reasons. Deck filler portion 90 includes a plurality of transversely-extending inflatable bladders. As illustrated, deck filler portion 90 includes two bladder sections located beneath the head and seat sections of the mattress, respectively, and is located outside of cover 12. Deck filler portion 90 may include one or more bladder regions, or may be located within interior region 14, without departing from the scope of the present disclosure.

Also provided in the illustrated embodiment are the pneumatic valve box 58 and an air supply tube assembly 82. Receptacle 88 is sized to house pneumatic valve box 58. In the illustrated embodiment, receptacle 88 is coupled to bottom cover portion 18 by Velcro® strips. Pneumatic box 58 is described below with reference to FIGS. 6A-B.

Figure 4:
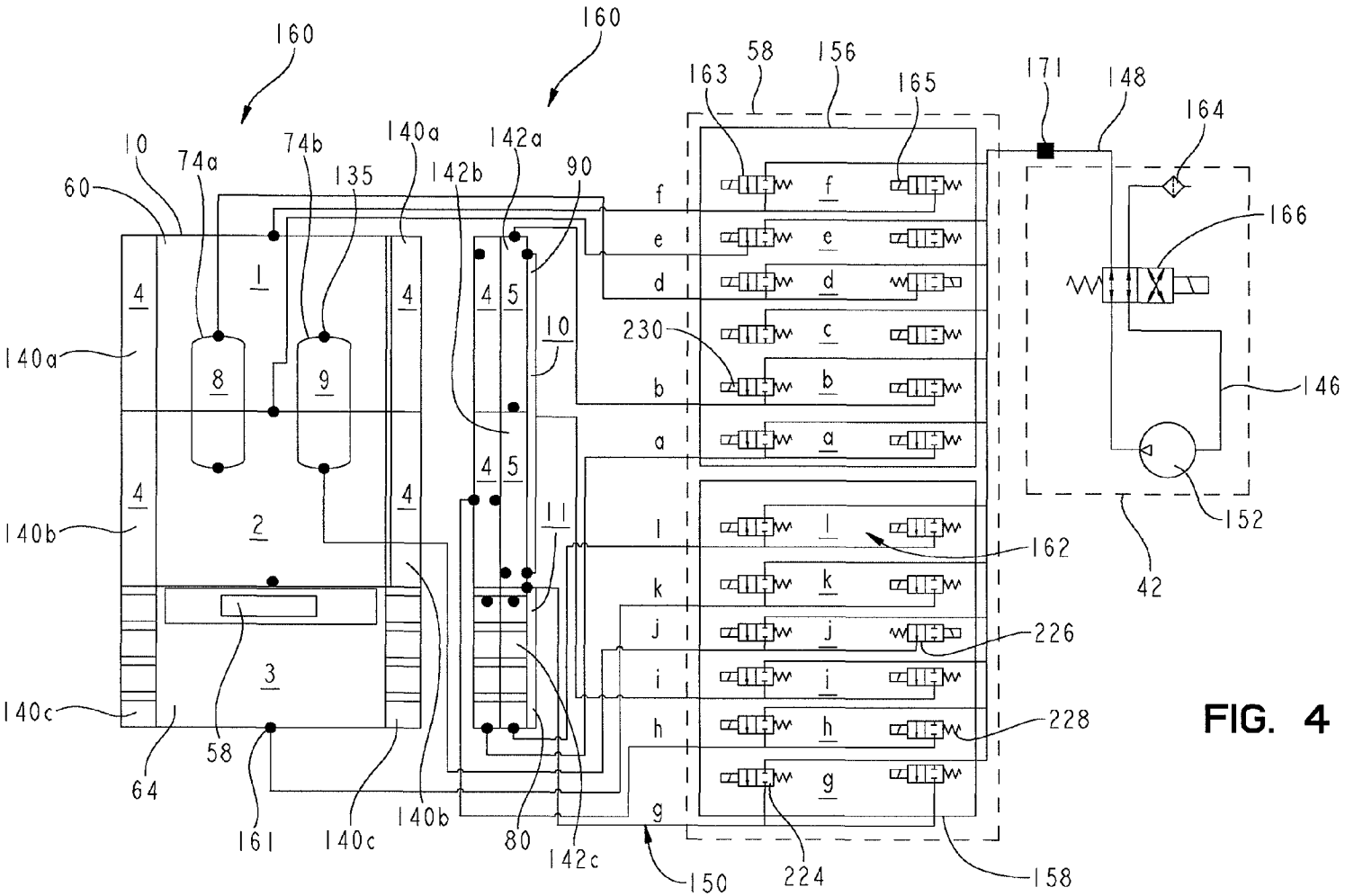
FIG. 4 is a schematic view of air zones of the illustrated patient support and associated air supply system.

A schematic diagram of the pneumatic control system of patient support 10 is shown in FIG. 4. Reading FIG. 4 from second to first, there is shown a simplified top view of patient support 10 with portions removed to better illustrate the various air zones 160, a simplified side view of patient support 10, a schematic representation of pneumatic valve box 58, a schematic representation of control unit 42, and air lines 146, 148, 150 linking control unit 42, valve box 58, and air zones 160.

As shown in FIG. 4, air zones 160 of patient support 10 are assigned as follows: zone 1 (zones are indicated by an underlined number) corresponds to head section bladder assembly 60, zone 2 corresponds to seat section bladder assembly 62, zone 3 corresponds to foot section bladder assembly 64, zone 4 corresponds to upper side bolsters 140, zone 5 corresponds to lower side bolsters 142, zone 6 corresponds to upper foot bolsters 140, zone 7 corresponds to lower foot bolsters 142, zone 8 corresponds to first turn-assist bladder 74, zone 9 corresponds to second turn-assist bladder 74, zone 10 corresponds to deck filler 90, and zone 11 corresponds to foot filler 80.

An air line 150 couples each zone 160 to a valve assembly 162 in valve box 58. Valve box 58 is located in the foot section 34 of patient support 10. Illustratively, valve box 58 is releasably coupled to bottom portion 18 of cover 12 in interior region 14, i.e., by one or more Vecro®-brand fasteners or other suitable coupler.

Each air line 150 is coupled at one end to an inlet port 135 on the corresponding bladder or bladder assembly. Each air line 150 is coupled at its other end to a valve assembly 162. Each valve assembly 162 includes first or fill valve 163 and a second or vent valve 165. First valves 163 are coupled to air supply 152 of control unit 42 by air lines 148. First valves 163 thereby operate to control inflation of the corresponding zone 160 i.e. to fill the zone with air. Second valves 165 operate to at least partially deflate or vent the corresponding zone 160, for example, if the internal air pressure of the zone 160 exceeds a predetermined maximum, or if deflation is necessary or desirable in other circumstances (such as a medical emergency, or for transport of patient support 10).

Each valve 163, 165 has an open mode 224 and a closed mode 226, and a switching mechanism 228 (such as a spring) that switches the valve from one mode to another based on control signals from control unit 42. In closed mode 226, air flows from air supply 152 through the value 163 to the respective zone 160 to inflate the corresponding bladders, or in the case of vent valves 165, from the zone 160 to atmosphere. In open mode 228, no inflation or deflation occurs.

In the illustrated embodiment, an emergency vent valve 230 is provided to enable quick deflation of turning bladders 74 which draws air from atmosphere through a filter 164 and also vents air to atmosphere through filter 164. Air supply 152 is an air pump, compressor, blower, or other suitable air source.

Air supply 152 is coupled to a switch valve 155 by air line 146. Switch valve 166 operates to control whether inflation or deflation of a zone occurs. An optional proportional valve 171 maybe coupled to air line 148 to facilitate smooth inflation or deflation of turn-assist bladders 74, or for other reasons.

In the illustrated embodiment, valve box 58 includes a first valve module 156 and a second valve module 158. First valve module 156 includes valves generally associated with a patient's first side (i.e., first side, from the perspective of a patient positioned on patient support 10) and second valve module 158 includes valves generally associated with a patient's second side (i.e., second side).

The various zones 160 are separately inflatable. Certain of the zones 160 are inflated or deflated to allow patient support 10 to conform to different bed frame configurations. For example, the deck filler 90 (zone 10 in FIG. 4) is inflated to conform patient support 10 to certain bed frame configurations, such as step deck configurations including the TotalCare® and CareAssist® bed frames, made by Hill-Rom, Inc., the assignee of the present disclosure, but is deflated when patient support 10 is used with a flat deck bed frame, such as the Advanta® bed made by Hill-Rom, Inc. As another example, the foot filler 80 (zone 11 in FIG. 4) is inflated when patient support 10 is used with the VersaCare®, TotalCare®, or CareAssist® beds, but the lower side bolsters 142 (zone 5 in FIG. 4) are not inflated when patient support 10 is used with a VersaCare® bed. As still another example, the lower foot bolsters 142 (zone 7 in FIG. 4) are inflated when patient support 10 is used on flat decks or other bed frames, including the Advanta® and VersaCare® bed frames made by Hill-Rom, Inc.

Figure 5A:
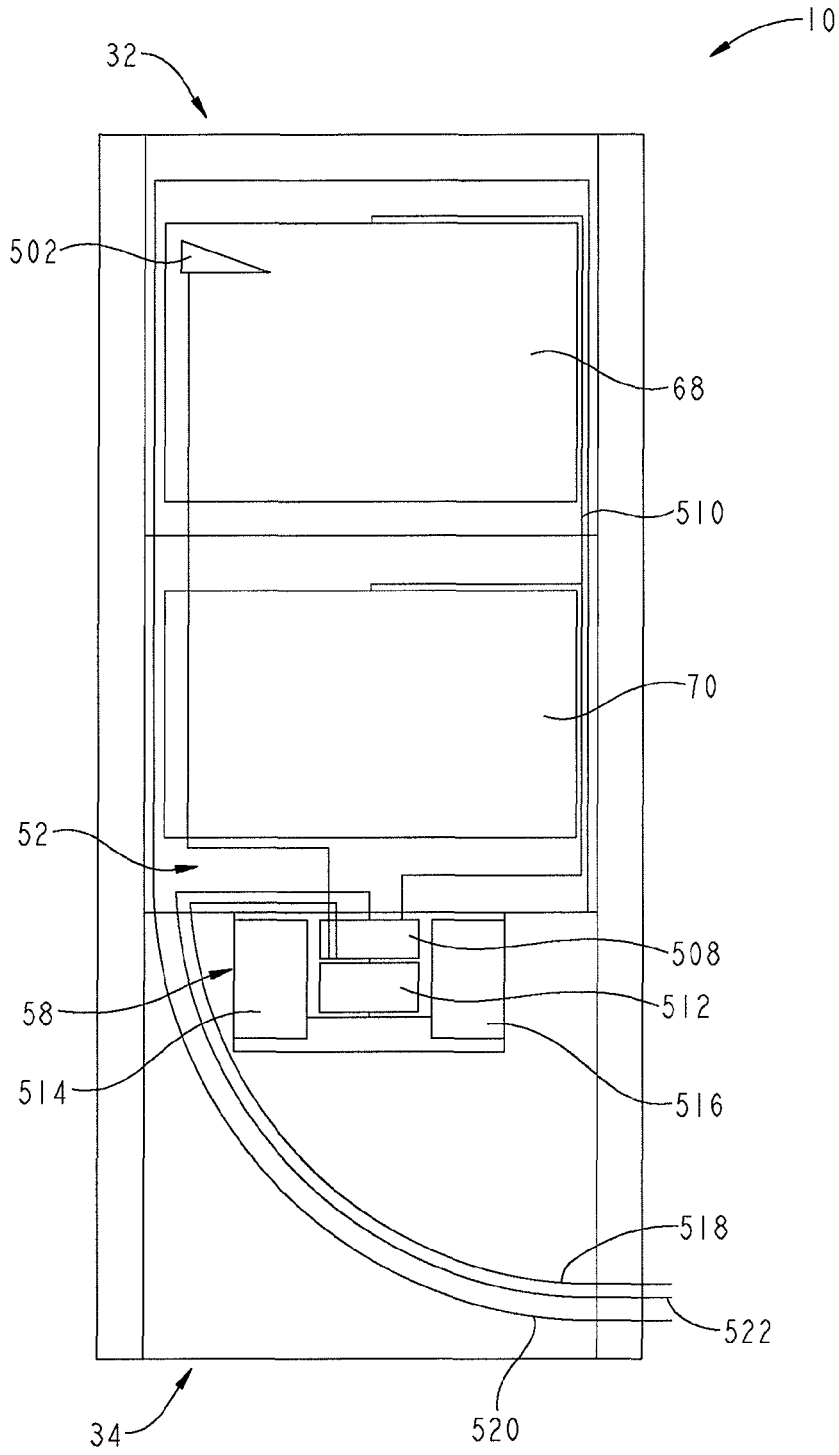
FIGS. 5A and 5B are schematic diagrams of portions of a control system for the illustrated patient support.
Figure 5B:
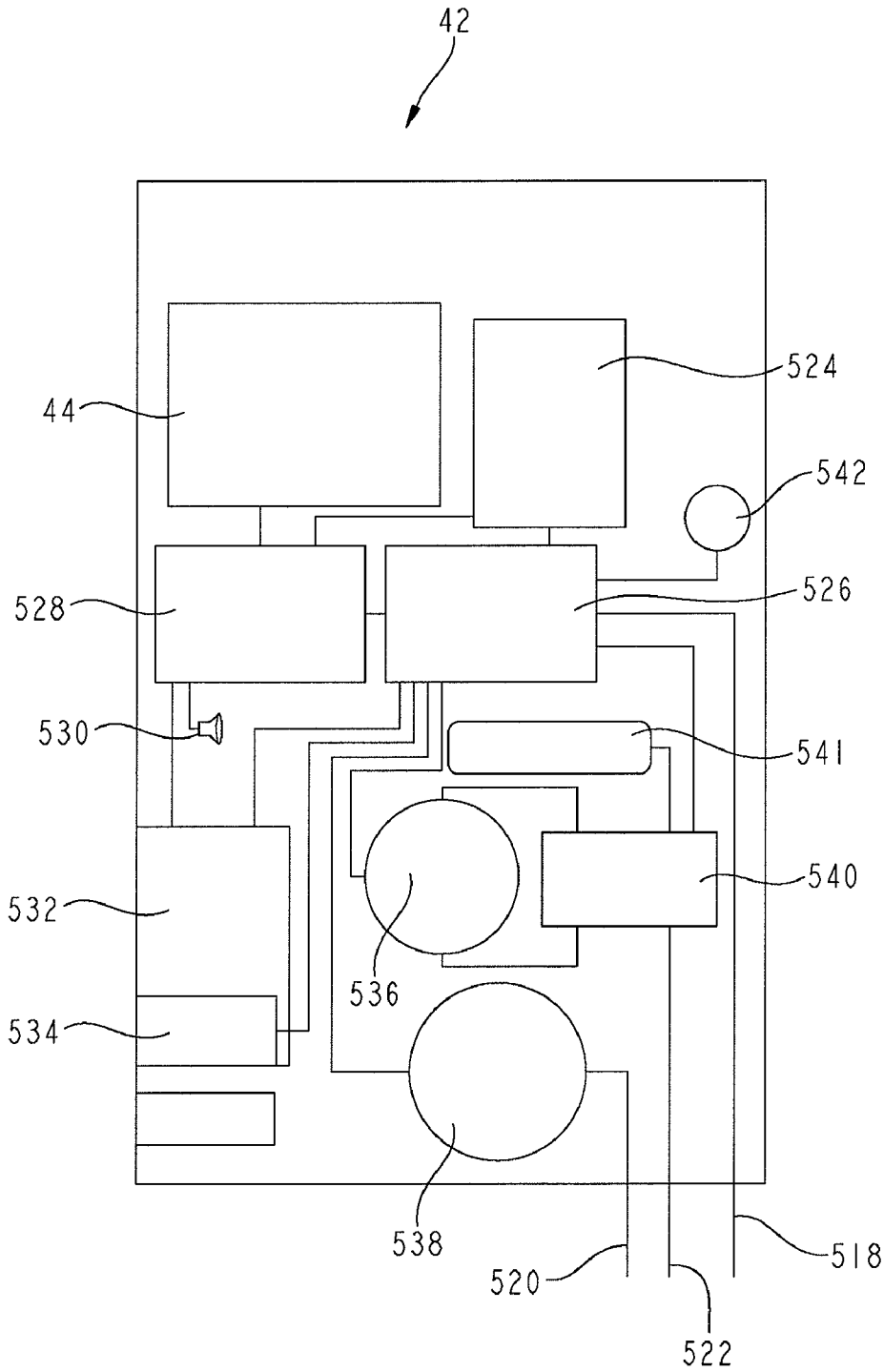

FIGS. 5A and 5B are a simplified schematic diagram of a control system and the patient support or mattress 10 of the present disclosure. FIG. 5A illustrates the patient support 10 including the various components of patient support 10 whereas FIG. 5B illustrates the control unit 42 and various components therein. The patient support 10 includes the sensor pad 52 which is coupled to the pneumatic valve control box 58 as previously described. The sensor pad 52 includes a head sensor pad 68 and a seat sensor pad 70. The head sensor pad 68 is located at the head end 32 of the mattress 10. The seat sensor pad 70 is located at a middle portion of the mattress 10 which is located between the head end 32 and a location of the pneumatic valve control box 58. The seat sensor pad 70 is located such that a patient laying upon the mattress 10 may have its middle portion or seat portion located thereon when in a reclined state. In addition, when the head end 32 of the mattress 10 is elevated, the seat portion of the patient is located upon the seat sensor pad 70. As previously described with respect to FIG. 3, the head sensor pad 68 is located beneath the head section bladder assembly 60 and the seat sensor pad 70 is located beneath the seat section bladder assembly 62. Each one of the sensors of the head sensor pad 68 or the seat sensor pad 70 is located beneath on at least adjacent to one of the upstanding cylindrical bladders or cushions 50. A head angle sensor 502 is coupled to the control box 58 where signals received from the sensor 52 may provide head angle information and pressure adjustment information for adjusting pressure in the seat bladders 62.

The sensor pad 52 is coupled through the associated cabling to the pneumatic control box 58. The pneumatic control box 58 includes a multiplexer 508 coupled to the head sensor pad 68 and the seat sensor pad 70 through a signal and control line 510. The multiplexer board 508 is also coupled to an air control board 512 which is in turn coupled to a first valve block 514 and a second valve block 516. A communication/power line 518 is coupled to the control unit 42 of FIG. 5B. Likewise, a ventilation supply line 520 which provides for air flow through the patient support 10 for cooling as well as removing moisture from the patient is also coupled to the control unit 42 of FIG. 5B. An air pressure/vacuum supply line 522 is coupled to the control unit 42 as well.

The control unit 42 of FIG. 5B, also illustrated in FIG. 1, includes the display 44, which displays user interface screens, and a user interface input device 524 for inputting to the control unit 42 user selectable information, such as the selection of various functions or features of the present device. The selections made on the user interface input device 524 control the operation of the patient support 10, which can include selectable pressure control of various bladders within the mattress 10, control of the deck 6, for instance to put the bed 2 in a head elevated position, as well as displaying the current state of the mattress or deck position, and other features.

An algorithm control board 526 is coupled to the user interface input device 524. The algorithm control board 526 receives user generated input signals received through the input device 524 upon the selection of such functions by the user. The input device 524 can include a variety of input devices, such as pressure activated push buttons, a touch screen, as well as voice activated or other device selectable inputs. The algorithm control board 526 upon receipt of the various control signals through the user input device 524 controls not only the operation of the mattress 10 but also a variety of other devices which are incorporated into the control unit 42. For instance, the algorithm control board 526 is coupled to a display board 528 which sends signals to the display 44 to which it is coupled. The display board 528 is also connected to a speaker 530 which generates audible signals which might indicate the selection of various features at the input device 24 or indicate a status of a patient positioned on patient support (e.g. exiting) or indicate a status of therapy being provided to the patient (e.g., rotational therapy complete). The algorithm control board 526 receives the required power from power supply 532 which includes an AC input module 534, typically coupled to a wall outlet within a hospital room.

The algorithm control board 526 is coupled to an air supply, which, in the illustrated embodiment includes a compressor 536 and a blower 538. Both the compressor 536 and the blower 538 receive control signals generated by the algorithm control board 526. The compressor 536 is used to inflate the air bladders. The blower 538 is used for air circulation which is provided through the ventilation supply line 520 to the mattress 10. It is, however, possible that the compressor 536 maybe used to both inflate the bladders and to circulate the air within the mattress 10. A pressure/vacuum switch valve 540 is coupled to the compressor 536 which is switched to provide for the application of air pressure or a vacuum to the mattress 10. A muffler 541 is coupled to the valve 540. In the pressure position, air pressure is applied to the mattress 10 to inflate the mattress for support of the patient. In the vacuum position, the valve 540 is used to apply a vacuum to the bladders therein such that the mattress maybe placed in a collapsed state for moving to another location or for providing a CPR function, for example. A CPR button 542 is coupled to the algorithm control board 526.

As illustrated, the algorithm control board 526, the compressor 536, the blower 538, and the user input device or user control module 524 are located externally to the mattress and are a part of the control unit 42, which maybe located on the footboard 38 as shown in FIG. 1. The sensors and sensor pad 52, the pneumatic valve control box 58, and the air control board or microprocessor 512 for controlling the valves and the sensor pad system 52 are located within the mattress 10. It is within the present scope of the disclosure to locate some of these devices within different sections of the overall system, for instance, such that the algorithm control board 526 could be located within the mattress 10 or the air control board 512 could be located within the control unit 42.

Figure 6A:
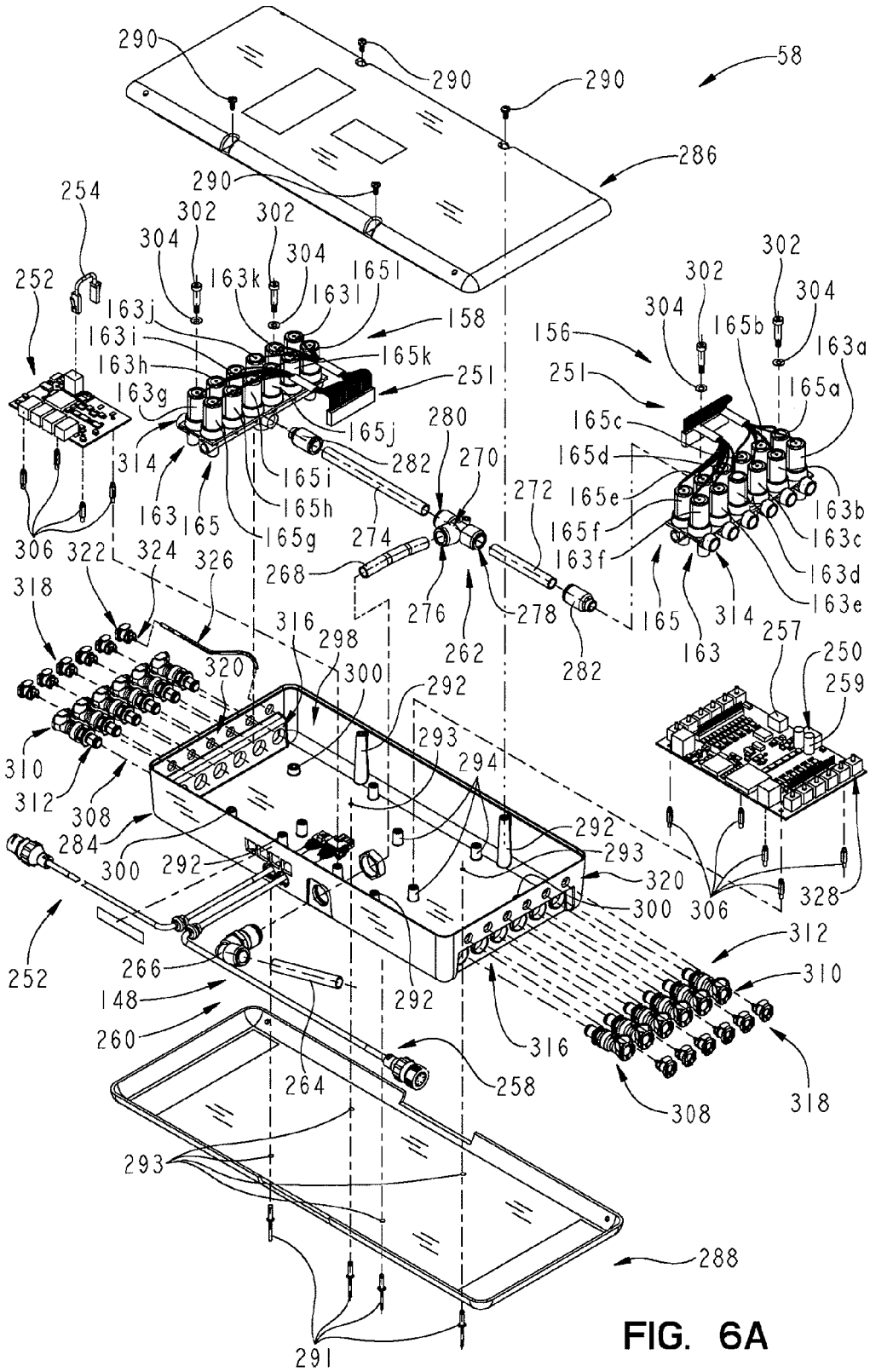
FIG. 6A is an exploded view of an exemplary pneumatic assembly.
Figure 6B:
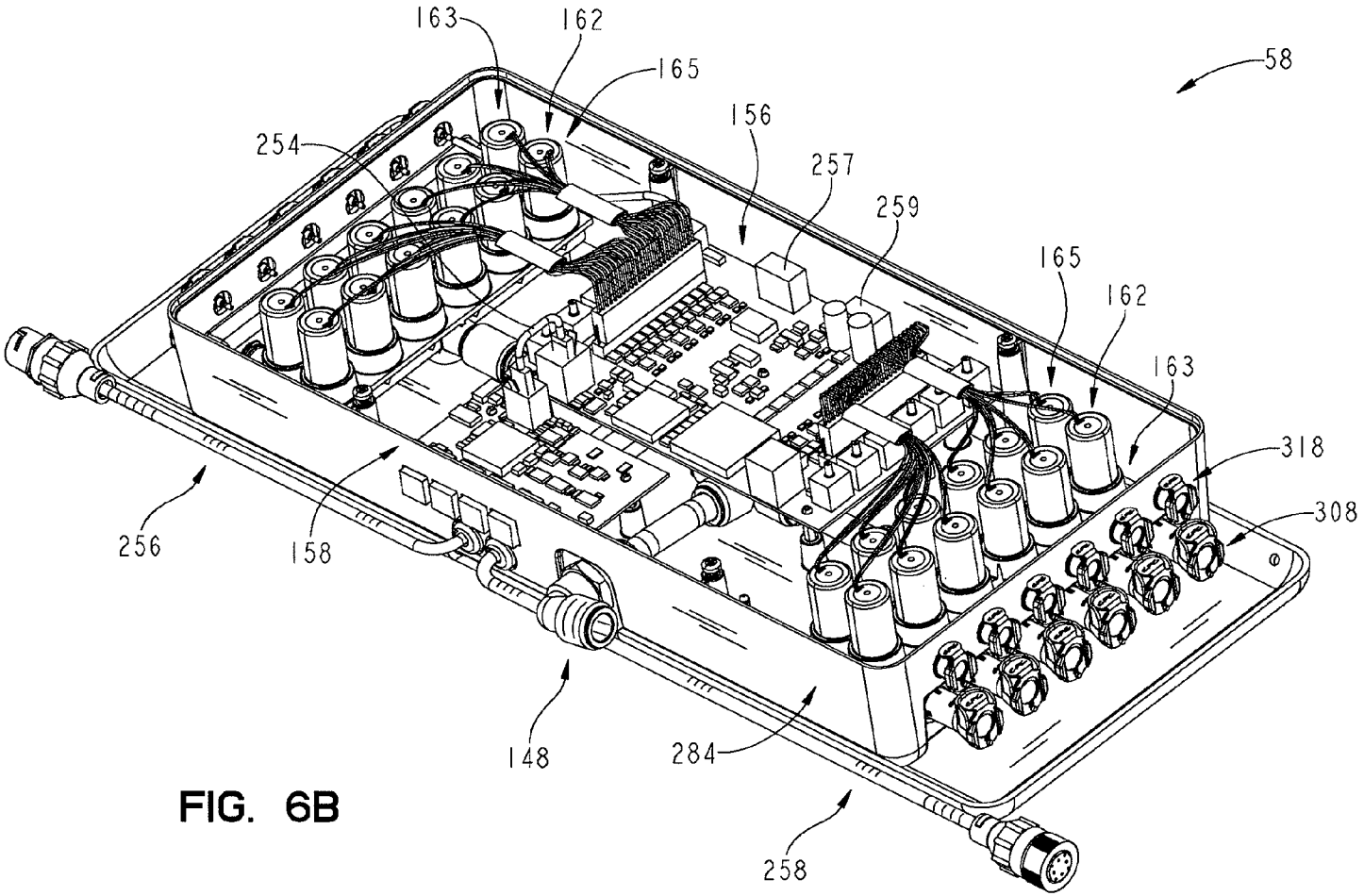
FIG. 6B is a perspective view of the pneumatic assembly of FIG. 6A.

As shown in FIGS. 6A-6B, control box 58 includes a multiplexer 252 and an air control board 250. Control board 250 is coupled to multiplexer 252 by a jumper 254. Multiplexer 252 is further coupled to head sensor pad 68 and seat sensor pad 70 through a signal and control line (not shown). Control board 250 is also coupled to first valve module 156 and second valve module 158 by wire leads 251. A communication/power line 258 couples control board 250 to the control unit 42. Communication line 258 couples to a communication plug 259 of control board 250. Jumper 254 couples multiplexer 252 to control board 250 for power and access to communication line 258. Wire leads 251 provide actuation power to first and second valve modules 156, 158.

As discussed above, first and second valve modules 156, 158 include fill valves 163 and vent valves 165. First valve module 156 includes fill valves 163*a-f* and vent valves 165*a-f*. Second valve module 156 includes fill valves 163*g-l* and vent valves 165*g-l*. Fill valves 163*a-l* and vent valves 165*a-l* are 12 Volt 7 Watt solenoid direct active poppet style valves in the illustrated embodiment. Control board 252 is able to actuate each fill valve 163*a-l* and vent valve 165*a-l* independently or simultaneously. Fill valves 163*a-l* and vent valves 165*a-l* are all able to be operated at the same time. In operation to initiate each valve 163, 165, control board 250 sends a signal to the valve to be operated. The signal causes a coil (not shown) within each valve to energize for ½ second and then switches to pulsate power (i.e., turn on and off at a high rate) to save power during activation. The activation in turn causes the valve to either open or close depending on which valve is initiated.

Fill valves 163 are coupled to air supply 152 of control unit 42 by second air line 148. Air line 148 includes an outer box line assembly 260 and an inner box line assembly 262. Outer box line assembly 260 includes an exterior inlet hose 264 and an elbow 266 coupled to exterior inlet hose 264. Inner box line assembly 262 includes an interior inlet hose 268 coupled to elbow 266, a union tee connector 270, a first module hose 272, and a second module hose 274. Connector 270 includes a first opening 276 to receive interior inlet hose 268, a second opening 278 to receive first module hose 272, and a third opening 280 to receive second module hose 274. First and second module hoses 272, 274 each couple through a male coupler 282 to first and second valve modules 156, 158 respectively. In operation, air from air supply 152 travels through supply line 148, enters outer box line assembly 260 through exterior inlet hose 264 and passes through elbow 266 to interior inlet hose 268. The air then travels from inlet hose 268 to union tee connector 270 where the air is divided into first module hose 272 and second module hose 274. The air passes through first and second module hoses 272, 274 into first and second valve modules 156, 158 respectively. The operation of first and second valve modules 156, 158 is described below.

Control box 58 includes a base 284, a cover 286, and a tray 288. Cover 286 includes a plurality of fasteners (i.e., screws) 290. Base 284 includes a plurality of threaded cover posts 292. Cover posts 292 are configured to receive screws 290 to couple cover 286 to base 284. Cover 286 and base 284 define an inner region 298. Tray 288 couples to base 284 with a plurality of rivets 291 riveted through a plurality of rivet holes 293 located on tray 288 and base 284.

Inner box line assembly 262, first valve module 156, second valve module 158, control board 250, and multiplexer 252 are contained within inner region 298. Base 284 further includes a plurality of control board posts 294, a plurality of multiplexer posts 296, and a plurality of module posts 300. First and second valve modules 156, 158 are coupled to module posts 300 by shoulder screws 302 and washers 304. Control board 250 and multiplexer 252 are respectively coupled to control board posts 294 and multiplexer posts 296 by a plurality of snap mounts 306.

First and second valve modules 156, 158 attach to third air lines 150 *a, b, d-f*, and *g-l* through a plurality of couplers 308. Couplers 308 include a first end 310 and a second end 312. Third air lines 150 *a, b, d-f*, and *g-l* each include a fitting (not shown) receivable by second end 312. Each first end 310 mounts to a port 314 in first and second valve modules 156, 158. First end 310 mounts through a plurality of openings 316 in base 284.

A plurality of feedback couplers 318 mount through a plurality of feedback openings 320 in base 284. Feedback couplers 318 include a first feedback end 322 and a second feedback end 324. First feedback end 322 couples to a feedback line (not shown) that in turn couples to a feedback port 135 located on each air zone 160. Second feedback end 324 receives a feedback transfer line 326. Each transfer line 326 couples to a pressure transducer 328 located on the control board 250. Pressure transducer 328 receives the pressure from each air zone 160 and transmits to control unit 42 a pressure data signal representing the internal air pressure of the zone 160. Control unit 42 uses these pressure signals to determine the appropriate pressures for certain mattress functions such as CPR, patient transfer, and max-inflate. Pressure signals from the transducer 328 coupled to the foot zone 160*k* are also used to maintain optimal pressure in foot zone 160*k*. In the illustrated embodiment, pressure in foot zone 160*k* (zone 3) is computed as a percentage of the pressure in seat zone 160*e* (zone 2). The pressures in seat zone 160*e* and head zone 160*f* are determined using both the transducers 328 and the pressure sensors 136. The pressures in one or more of the zones 160 maybe adjusted in real time. In another embodiment, the pressure transducers are mounted directly to the control board and inserted directly into the valve block. In this embodiment the feedback pressure is sensed in the valve block compared with sensing the pressure at each air zone. This configuration eliminates the need for a feedback transfer line because the pressure transducers are coupled directly to the valve block where they are sensing the pressure. Additional drawings illustrating this embodiment are attached hereto as Appendix A and incorporated herein by this reference.

As shown in FIG. 4, fill valves 163*a-l* and vent valves 165*a-l* are coupled to various portions of patient support 10 through third air lines 150 *a, b, d-f*, and *g-l*. Fill valve 163*a* and vent valve 165*a* are coupled to upper foot bolsters 140*c*, fill valve 163*b* and vent valve 165*b* are coupled to lower side bolsters 142 *a, b*, fill valve 163*c* is coupled to atmosphere and vent valve 165*c* is reserved for future therapies. Also, fill valve 163*d* and vent valve 165*d* are coupled to first turn assist 74*a*, fill valve 163*e* and vent valve 165*e* are coupled to seat bladders 62, fill valve 163*f* and vent valve 165*f* are coupled to head bladder assembly 60, fill valve 163*g* and vent valve 165*g* are coupled to foot filler 80, fill valve 163*h* and vent valve 165*h* are coupled to upper side bolsters 140 *a, b*, fill valve 163*i* and vent valve 165*i* are coupled to deck filler 90, fill valve 163*j* and vent valve 165*j* are coupled to first turn assist 74*b*, fill valve 163*k* and vent valve 165*k* are coupled to foot bladders 164, fill valve 163*l* and vent valve 165*l* are coupled to lower foot bolsters 142*c*. Vent valves 165*d*, j are biased in the open position to vent air from first and second turn assist 74*a*, 74*b* when first and second turn assist 74*a*, 74*b* are not in use. Vent valves 165*d, j* return to their open position if the mattress loses power or pressure venting air from the first and second turn assist 74*a*, 74*b*. When air is vented from a zone 160, the pressure in the zone 160 after deflation is determined by the control system 42, 58 in real time rather than being predetermined.

In one embodiment, a user enters an input command to control unit 42. Control unit 42 processes the input command and transmits a control signal based on the input command through communication line 258 to control board 250. Additionally or alternatively, control signals could be based on operational information from control unit 42 to increase or decrease pressure within one or more of the zones 160 based on information obtained from transducers 328 and/or sensors 136.

It should be noted that in the illustrated embodiment, the mattress controls 42, 58 are independent from operation of the bed frame 4. In other embodiments, however, bed frame 4 and mattress 10 maybe configured to exchange or share data through communication lines. For instance, data is communicated from bed frame 4 to mattress system 42, 58 and used to adjust support parameters of mattress 10. For instance, in one embodiment, a signal is transmitted from frame 4 when foot section 34 is retracting, so that mattress systems 42, 58 responds by decreasing internal pressure of vertical bladders 50 in foot assembly 64.

As described above, air supply 152 is capable of supplying air or acting as a vacuum to remove air from zones 160. While in supply mode, a microprocessor on control board 250 actuates corresponding fill valve 163*a-l* or vent valve 165*a-l* based on the control signal from control unit 42. For example, if the control signal indicates the pressure in head bladder assembly 160 is to be increased fill valve 163*f* is actuated.

However, if the control signal indicates the pressure in head bladder assembly 160 is to be decreased vent valve 165*f* is actuated. While in vacuum mode one or more fill valves 163*a-l* maybe actuated to allow for rapid removal of air within the corresponding zones.

An angle sensor cable 256 is provided to send a signal from a head angle sensor 502 to the control board 250. Angle sensor cable 256 couples to an angle plug 257 of control board 250. In the illustrated embodiment, head angle sensor 502 is located within head bolster assembly 76 as indicated by FIG. 5A. Head angle sensor 502 indicates the angle of elevation of the head end 32 of bed 2 as the head section of the frame 4 articulates upwardly raising the patient's head or downwardly lowering the patient's head.

Figure 7A:
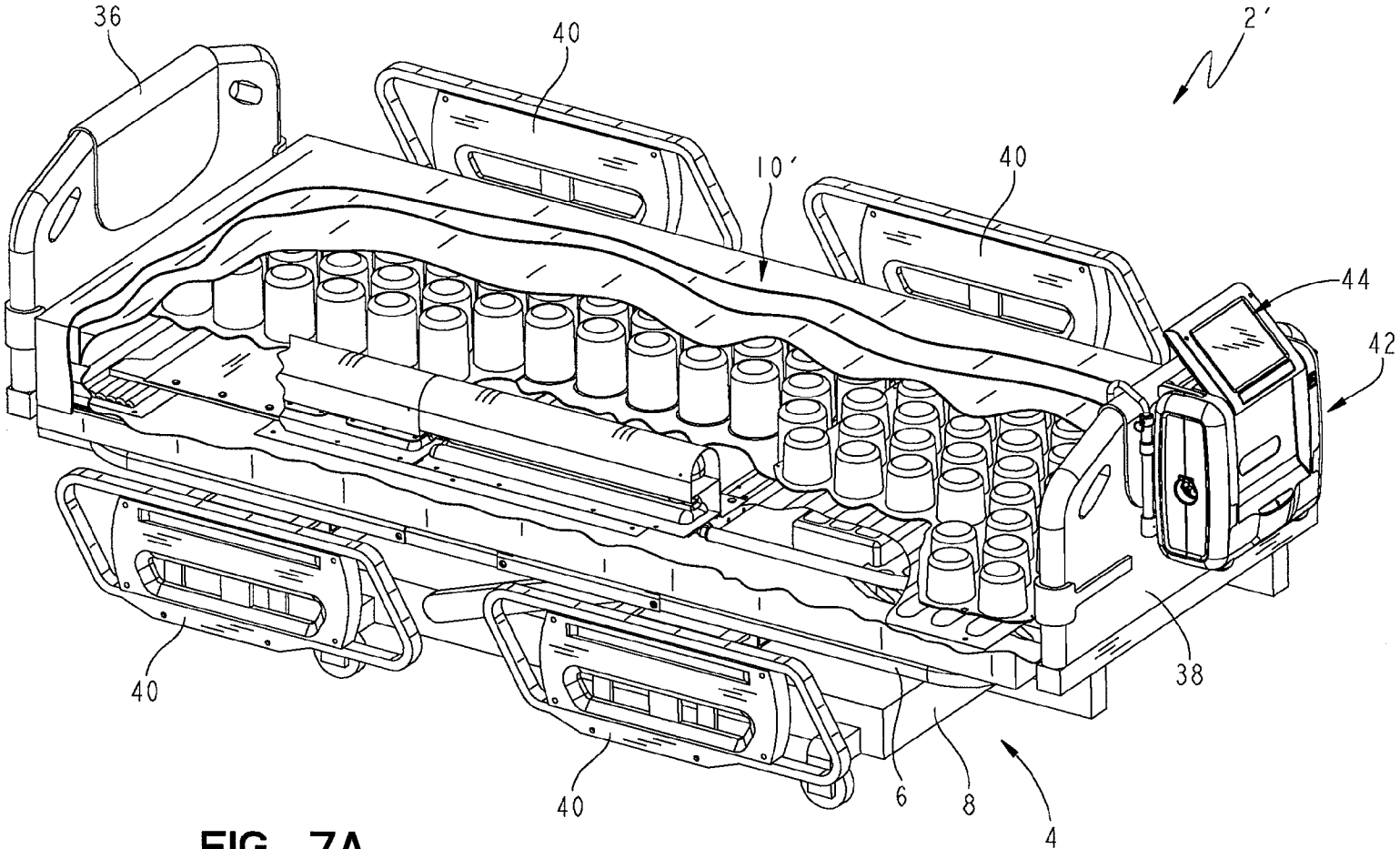
FIG. 7A is a perspective view of another embodiment of a patient support positioned on an exemplary hospital bed, with a portion of the patient support being cut away to show interior components of the patient support.
Figure 7B:
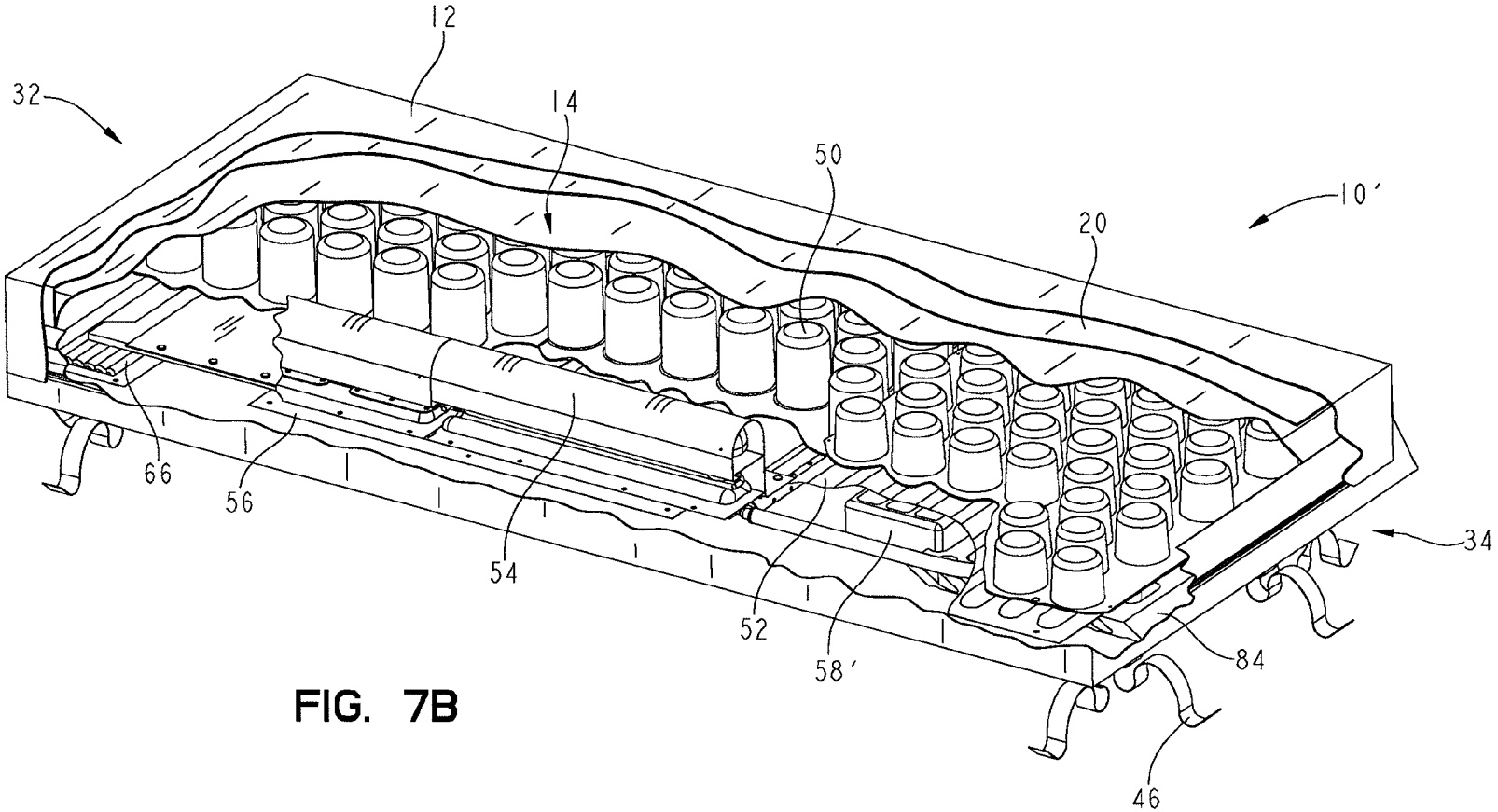
FIG. 7B is a perspective view of the embodiment of the patient support of FIG. 7A, with a portion being cut away to show interior components of the patient support.

FIGS. 7A-B show another embodiment of a patient support or mattress 10'. Patient support 10' is positioned on a bed 2'. Bed 2' is similar to bed 2 described above. Patient support 10' has an associated control unit 42' and an associated control box 58'. Control unit 42' is similar to control unit 42 described above and control box 58' is similar to control box 58 described above.

Figure 8:
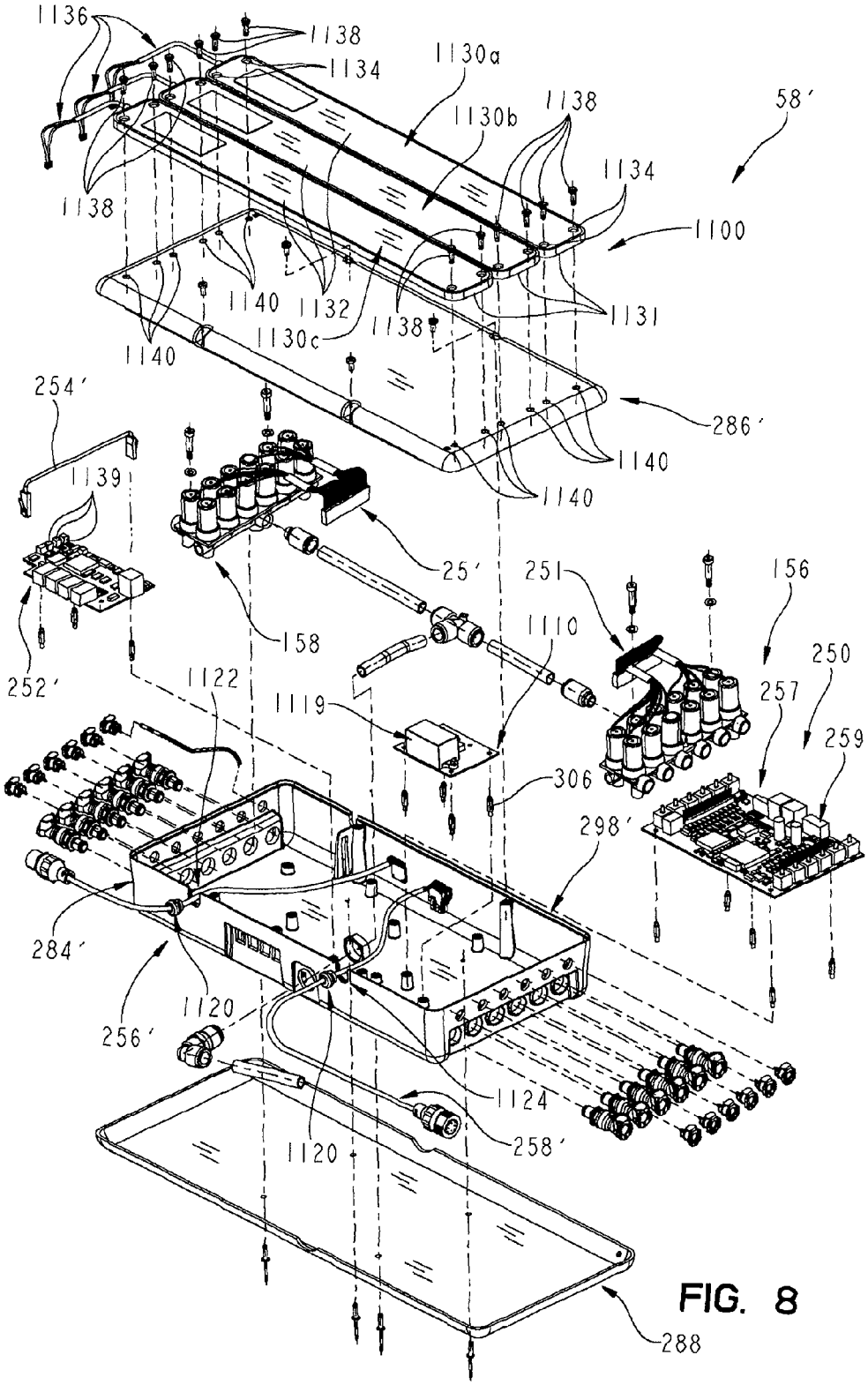
FIG. 8 is an exploded view of another embodiment of a pneumatic assembly.
Figure 9:
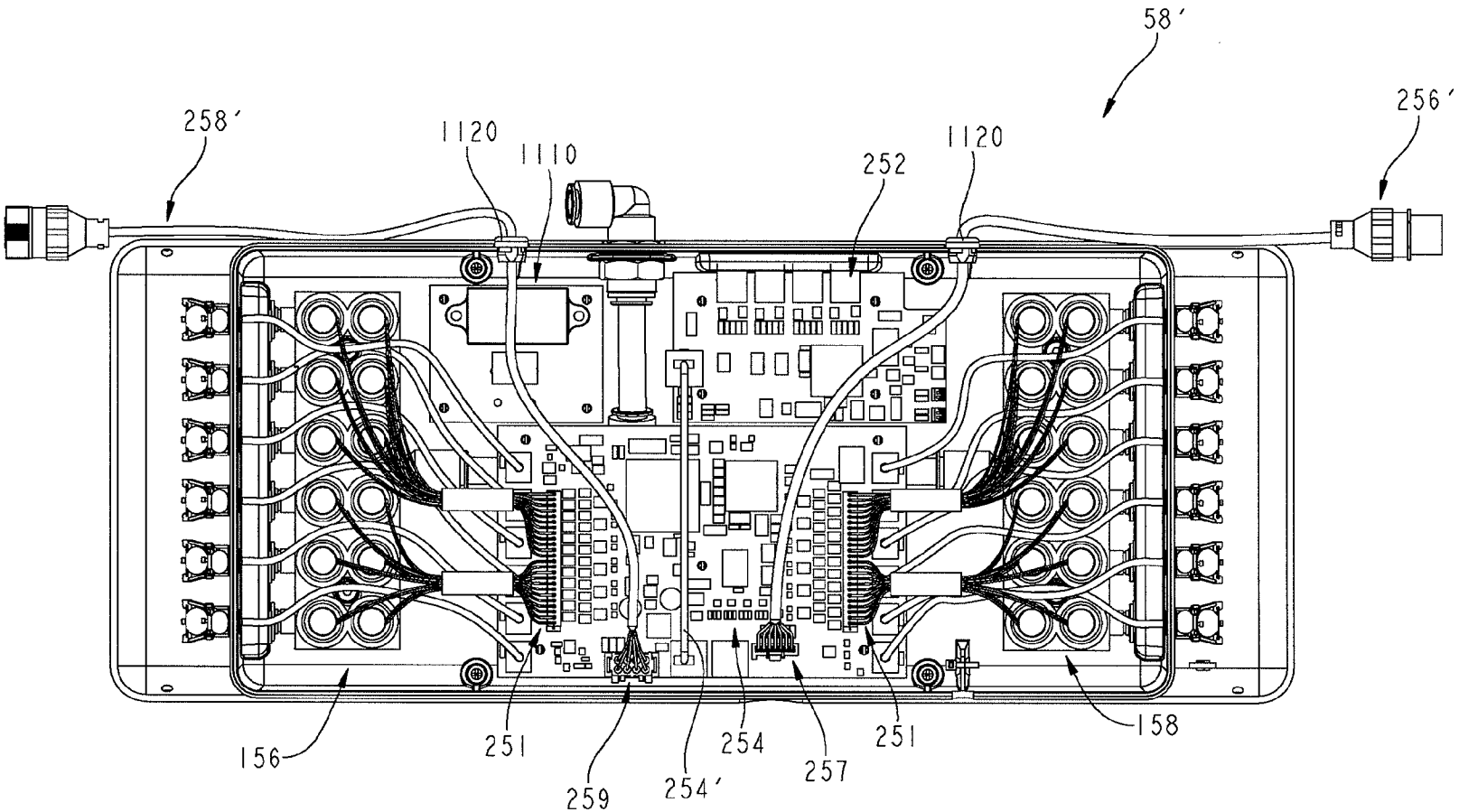
FIG. 9 is a plan view of the pneumatic assembly of FIG. 8.
Figure 10:
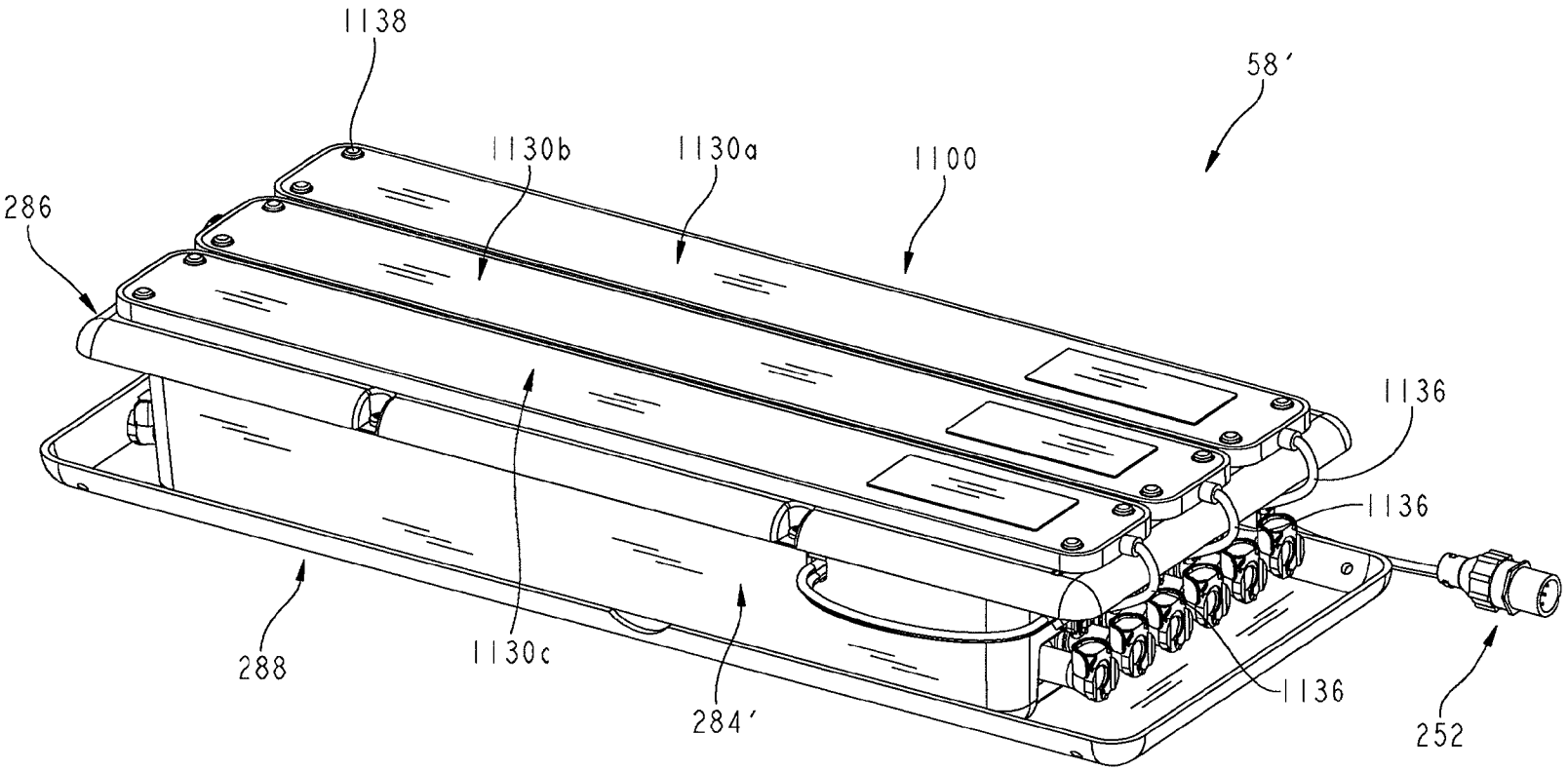
FIG. 10 is a perspective view of the pneumatic assembly of FIG. 8.

As shown in FIGS. 8-10, control box 58' includes a base 284', a cover 286', and a tray 288. Cover 286' and base 284' define an inner region 298'. Tray 288 couples to base 284'. As described in detail below, a sensor assembly 1100 is coupled to cover 286'. Control box 58' further includes a multiplexer 252', air control board 250, and a foot angle board 1110. Foot angle board 1110 is coupled to control board 250 for power and access to communication line 258'. Foot angle board 1110 is also operably coupled to a foot angle sensor 1111. The foot angle sensor 1111 is similar to head angle sensor 502 described above. The foot angle sensor 111 is located in the or adjacent to the foot section of the patient support 10'. In the illustrated embodiment, sensor 1111 is located in the control box 58'.

Control board 250 is coupled to multiplexer 252' by a jumper 254'. Multiplexer 252 is further coupled to head sensor pad 68, seat sensor pad 70, and foot sensor assembly 1100 through a signal and control line (not shown). Control board 250 is also coupled to first valve module 156 and second valve module 158 by wire leads 251. A communication/power line 258' couples control board 250 to the control unit 42' of FIG. 7A. Communication line 258' couples to communication plug 259 of control board 250. Jumper 254' couples multiplexer 252' to control board 250 for power and access to communication line 258'.

An angle sensor cable 256' is provided to send a signal from head angle sensor 502 to control board 250. Angle sensor cable 256' couples to angle plug 257 of control board 250. Angle sensor cable 256' and communication line 258' each include a grommet 1120. Each grommet 1120 is provided to support angle sensor cable 256' and communication line 258' in angle sensor cutout 1122 and communication line cutout 1124 respectively in control box 58'. Each grommet 1120 provides a fluid barrier to keep liquid from entering control box 58'.

Sensor assembly 1100 is generally located in the foot section of the patient support 10'. As shown best in FIGS. 8 and 10, sensor assembly 1100 is positioned above the control box 58'. Sensor assembly 1100 includes a plurality of sensors 1130*a-c*. In the illustrated embodiment, three sensors 1130*a-c* are provided, however, a smaller or greater number of such sensors may be provided in other embodiments. Each sensor 1130*a-c* includes a flexible backing 1131, a tape switch 1132, mounting apertures 1134, and an electrical lead 1136. Electrical leads 1136 may be gold plated, to prevent corrosion, for example. Electrical leads 1136 couple to sensor plugs 1139 in multiplexer 252'. A plurality of mounting fasteners 1138 are provided to attach sensor assembly 1100 to a plurality of cover apertures 1140. Mounting fasteners 1138 extend through mounting apertures 1134 and cooperate with cover apertures 1140 to mount sensor assembly 1100 to control box 58'.

At least one dimension (i.e., length, width) of each tape switch 1132 substantially corresponds to a dimension of the cover 286'. For example, as shown in FIG. 10, the length of the tape switches 1132 substantially corresponds to the length of the cover 286' of the control box 58'. Also as shown in FIG. 10, each of the sensors 1130*a-c* are of substantially the same size and shape, however, in other embodiments, this may not be the case.

Tape switches 1132 each include a pair of metal conductors (not shown). The conductors are normally spaced from one another by insulators (not shown). The conductors are adapted to contact one another when at least a portion of a patient's weight is located above, on top of, or over the sensor assembly 1100. The tape switches 1132 may be connected in parallel, for example, to prevent a false indication that a patient is not located over the foot section if at least one switch 1132 is closed. When a portion of a patient's body is located over the sensor assembly 1100 at least one tape switch 1132 will be closed. When no portion of the patient's body is located over sensor assembly 1100 tape switches 1132 will all be open.

Sensor assembly 1100 works in connection with sensor pad 52 to provide an indication to control unit 42 that a patient is supported on patient support 10'. Additionally, sensor assembly 1100 may provide an indication to the control box 58' that a portion of a patient is located over control box 58' and additional pressure should be added to the foot section of the patient support.

Additionally, sensor assembly 1100 may provide an indication that no portion of the patient is located over the sensor assembly 1100. When no portion of the patient is located over the sensor assembly 1100, the sensor assembly 1100 sends an indication signal to the control unit 42. The signal is sent through leads 1136 to plugs 1139 in multiplexer board 252'. The jumper 254' allows the signals to be sent through the control board 250 through communication line 258' to the control unit 42.

The control unit 42 then processes the signal to determine if a portion of the patient is located over either sensor pad 52 or foot sensor assembly 1100. If no portion of the patient is located over sensor pad 52 or foot sensor assembly 1100 an indication is made. The indication could be an audible alarm, a visual indication, or some other indication to a caregiver that the patient has exited the bed. If a portion of the patient is located over the foot sensor assembly 1100 but not over sensor pad 52, the pressure in foot section bladder assembly 64 may be increased.

Figure 11:
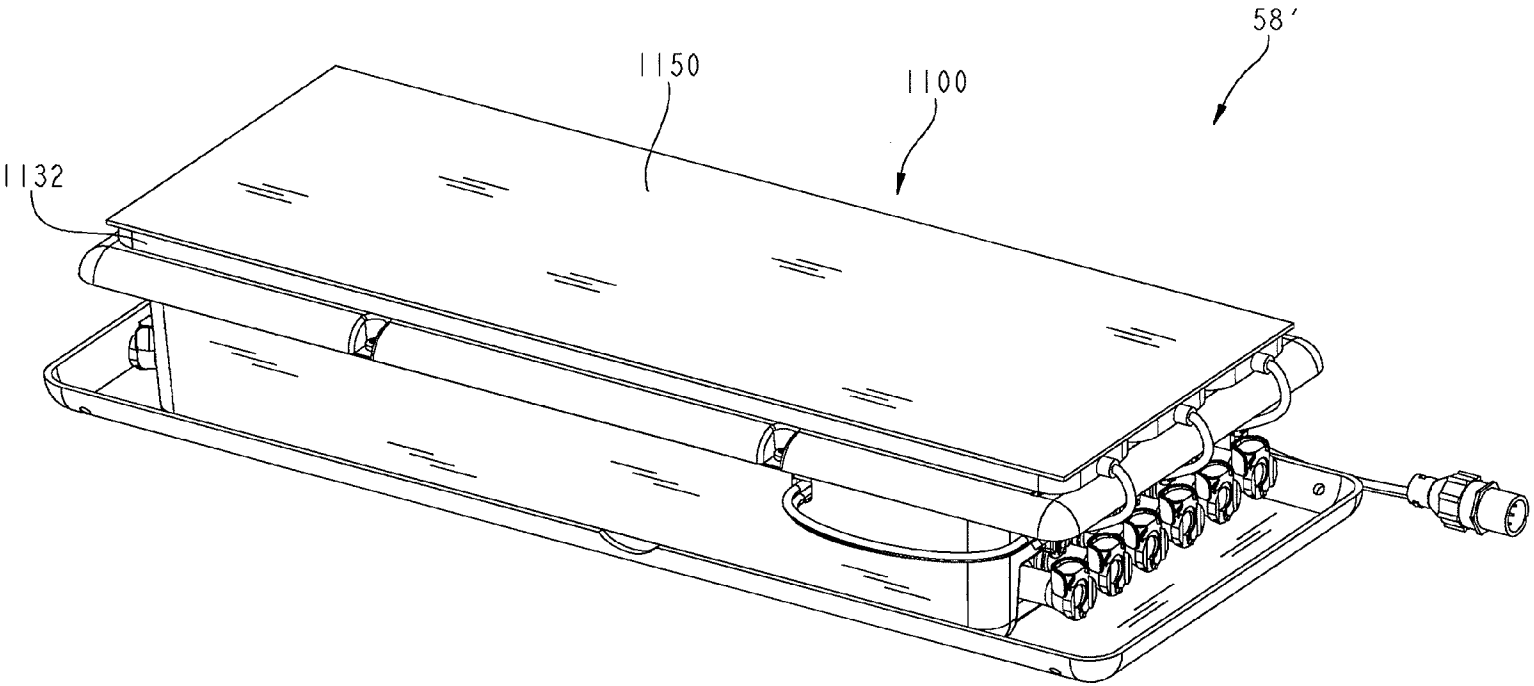
FIG. 11 is a perspective view of another embodiment of a pneumatic assembly.

As shown in the embodiment of FIG. 11, a plate 1150 may be provided over sensor assembly 1100. Plate 1150 is mounted to sensor assembly 1100 with an adhesive. Plate 1150 provides a surface over all three sensors 1132. In one embodiment, plate 1150 operates to actuate at least one sensor 1132 when a portion of a patient is located over the control box 58'. Plate 1150 may be made of aluminum, for example, 0.033" to 0.05" thick. In other embodiments, the plate 1150 could be removed, made using a different thickness, or made from a different metal, plastic or other suitable material.

Figure 12:
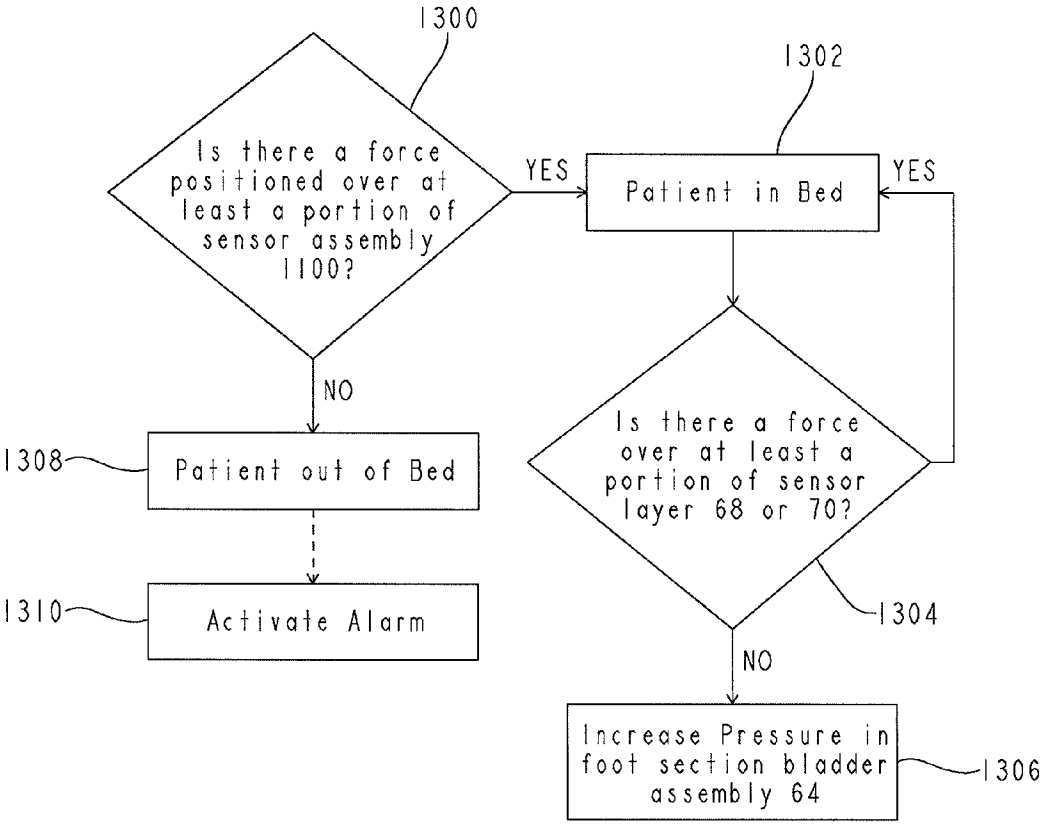
FIG. 12 is a flow chart showing an exemplary method of an operation of the patient support of FIG. 7A.

FIG. 12 illustrates an exemplary method of operation of the sensor assembly 1100. The first step 1300 of the method is to determine if there is a force or weight positioned over at least a portion of sensor assembly 1100. If a force is detected then it is determined that a patient is in the bed (step 1302). The next step 1304 determines if there is a force over sensor pad 68 or 70. If there is a force over sensor pad 68 or 70, then the system returns to step 1302. If no force is detected in sensor pad 68 or 70 then step 1306 occurs increasing pressure in foot section bladder assembly 64. The pressure in foot section bladder assembly 64 may be increased to help a patient in exiting the bed. Additionally, the increase in pressure may aid in a patient's comfort when the patient is seated over control box 58' or portion of the patient's body is positioned over the foot section. Referring back to step 1300, if no force is detected over at least a portion of sensor assembly 1100 then the patient is considered to be out of the bed. In some embodiments, a bed exit alarm may be included with patient support 10 or 10'. If there is a bed exit alarm, step 1310 activates the alarm. Such an alarm may be used to notify a caregiver that a patient's safety is at risk, or for other reasons. The alarm may be communicated to a caregiver over an electronic or wireless telephone or computer network, audible or visual signal or similar notifying mechanism.

For additional details of sensor pad 52 see U.S. Provisional Patent Application Ser. No. 60/697,748, entitled PRESSURE CONTROL FOR A HOSPITAL BED which is assigned to the assignee of the present disclosure, the disclosure of which is incorporated herein by this reference. For additional details of tape switches 1132 see U.S. Pat. No. 4,539,560, entitled BED DEPARTURE DETECTION SYSTEM which is assigned to the assignee of the present disclosure, the disclosure of which is incorporated herein by this reference.

Figures 13A, 13B:
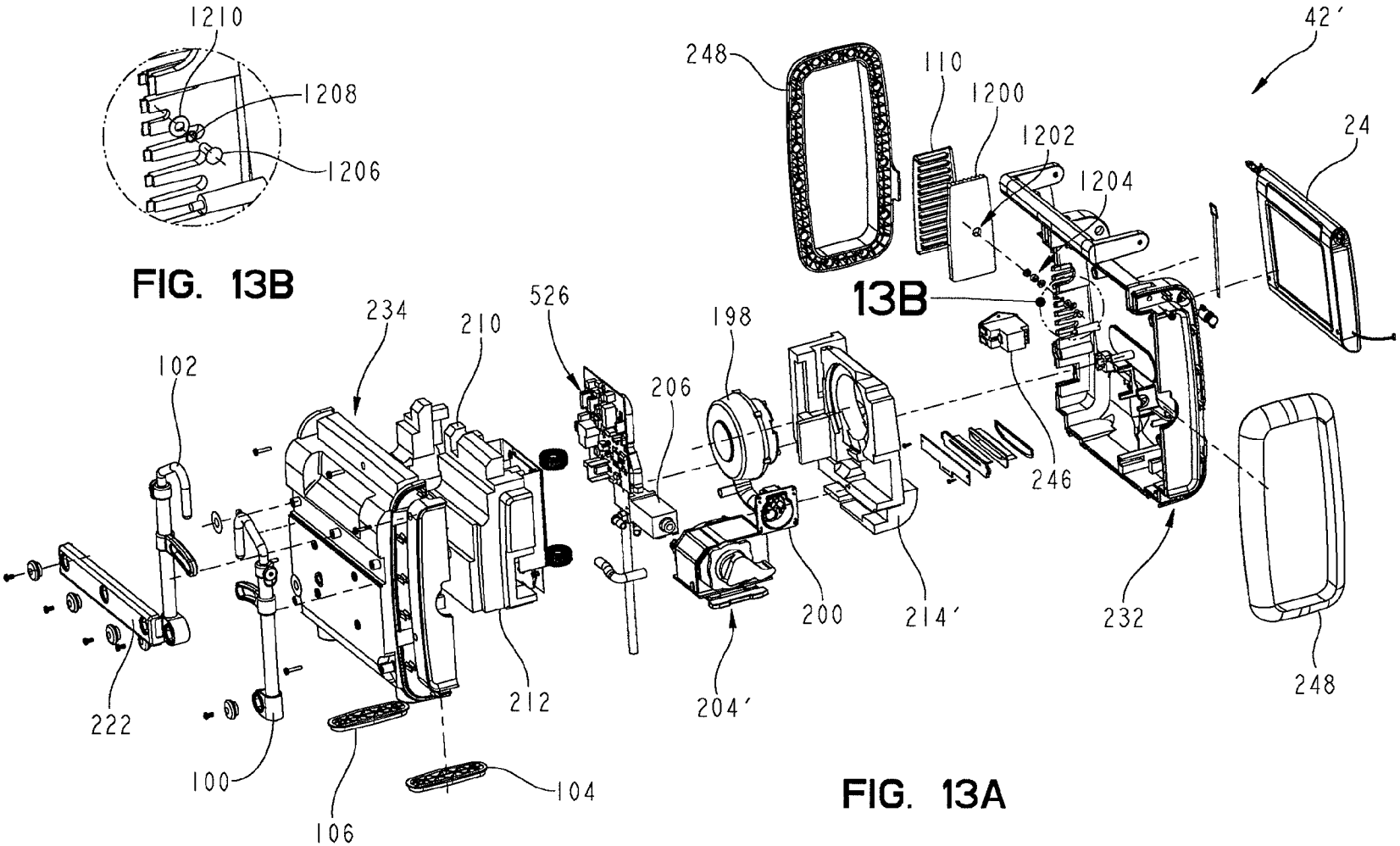
FIG. 13A is an exploded view of an exemplary control unit.
FIG. 13B is a detailed portion of FIG. 13A.

FIG. 13A shows an exploded view of the interior components of the control unit 42'. The components are viewed from the perspective of a person looking at the rear housing 234. Additional details to those described below of the control unit 42' may be found above or in U.S. Provisional Patent Application Ser. No. 60/697,708, entitled CONTROL UNIT FOR A PATIENT SUPPORT which is assigned to the assignee of the present disclosure, the disclosure of which is incorporated herein by this reference.

In the illustrated embodiment, the front housing 232 supports a foam insert 214', into which most of the interior components are loaded. Foam insert 214' aids in holding all of the internal components in proper position.

The blower 198 is a commercially available blower such as Ametek model no. 150166-00. The switching valve 206 is a pressure/vacuum valve such as is commercially available from Numatics model no. 92114-2. The various pneumatic tubing used to interconnect the pneumatic items in the control systems are generally conventional pneumatic tubing. Also, various connectors and wiring are used to interconnect the electrical items in the control unit 42' and the patient support 10. Rubber bumpers and screw caps are used to cover and hide screws and other fasteners on the control unit assembly.

Figure 14:
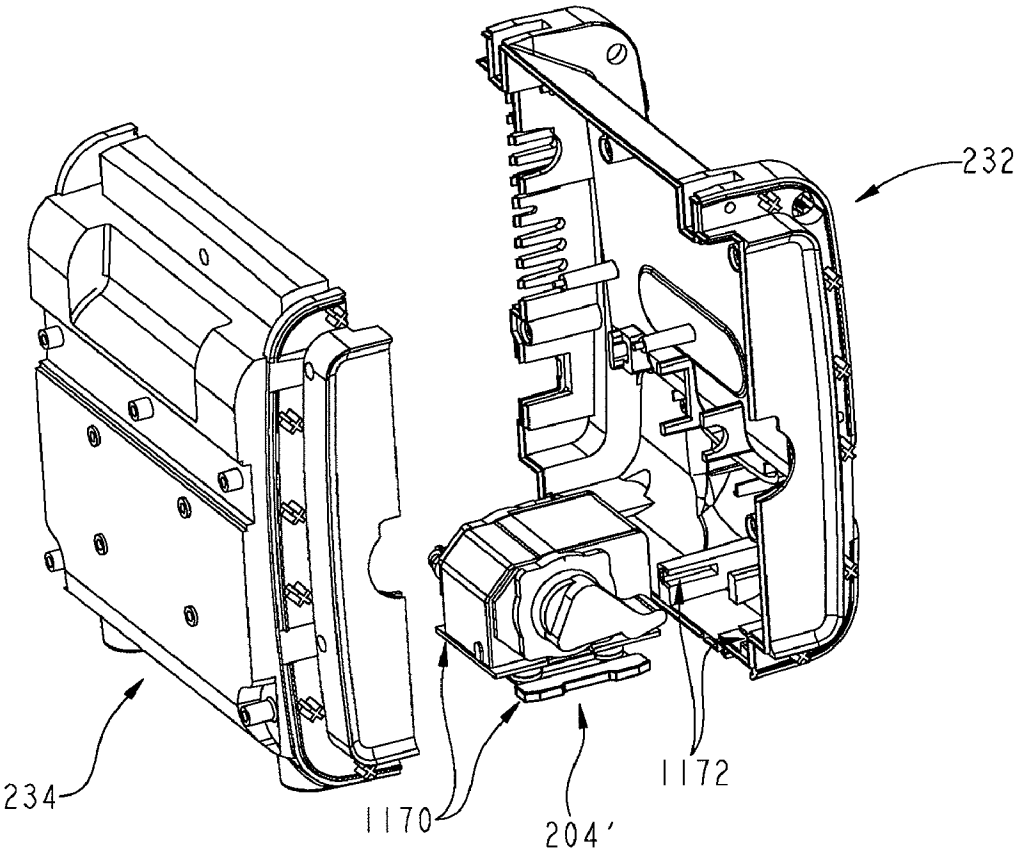
FIG. 14 is a simplified exploded view of the control unit of FIG. 13A.

As shown in FIG. 14, compressor 204' includes a pair of flanges 1170 located on each side. Flanges 1170 are configured to slide into a pair of front slots 1172 located on front housing 232 and a pair of slots (not shown) on the rear housing. Flanges 1170 provide for fastener free coupling of compressor 204' into front and rear housings 232, 234.

The power input 246 includes a power supply, for example XP model no. ECM130PS12, a power inlet, for example Corcom model no. PE0S0DBX0, and a 120V power filter, such as Corcom model no. 3MZ1.

The foam inserts 210, 212 hold other components in place, for example the insert 212 keeps the blower, compressor, and power supply in position, and the insert 210 keeps the power supply, speaker, and power inlet in proper position. The insert 214 is also made of EPAC (Electronic Packaging Assembly Concept) foam and is used to hold the algorithm control unit, compressor, blower, switching valve, and power supply in place. The use of these foam inserts 210, 212, 214 eliminates the need for a metal chassis and fasteners.

The first and second end caps 248 conceal the screws and other molding issues on the front and back housing 232, 234. The end caps are made from Santoprene Thermo Plastic Rubber (TPR). The end cap 248 also provide cushioning for protection during impacts and drops. The first end cap 248, positioned proximate to the friction hinge 142, also includes a set of ribs to help keep the friction hinge in place. The housing portions 232, 234, 248 are interlocking walls designed to prevent liquid ingress.

The filter holder 110 positions a foam air filter 1200 and maintains it in front of the air inlet ports on the front and back housing 232, 234. The filter 110 holder is molded in polycarbonate. Air filter 1200 includes a mounting aperture 1202 configured to receive a fastener 1204, shown in detail in FIG. 13B. Fastener 1204 includes a screw 1206, a lock washer 1208, and a flat washer 1210. Fastener 1204 extends from front housing 232 through mounting aperture 1202 to support air filter 1200 in fixed position relative to filter holder 110.

The hose receptacle 200 receives and holds the hose end. The receptacle 200 also holds a gasket to prevent air leakage. Attached to the receptacle are one or more air lines and electrical contacts (i.e., three and eight, respectively, in the illustrated embodiment). The receptacle to 200 is made from Valox or another very strong material. The receptacle 200 is held in place by the front and back housings 232, 234. The receptacle and corresponding hose are described in greater detail in U.S. Provisional Patent Application Ser. No. 60/636,252, assigned to the assignee of the present disclosure, and incorporated herein by reference.

The rear housing portion 234 holds and compresses the back and side foam insert 212, in order to hold all of the internal components in proper position. The rear housing 234 also provides mounting points for the hanger assembly 100, 102. Rear housing 234 is made from Noryl structural foam sufficient to withstand applicable drop test requirements.

The control unit 42' may be attached to a footboard or other portion of a bed frame, or may be positioned on the floor. Hook assemblies 100, 102 are provided in order to attach the control unit 42 to a portion of a bed, i.e., a footboard. The hooks are configured to support at least four times the weight of the control unit 42, without failing. Each of the hooks 100, 102 may be rotated or otherwise reconfigured in various positions in order to adapt to a variety of different footboards or other bed portions. A similar suitable hook assembly is described in U.S. Pat. No. 6,735,799 to Ellis, et al., assigned to the assignee of the present intervention and incorporated herein by this reference.

The present disclosure describes certain exemplary embodiments, variations, and applications of the present invention. It is understood that other variations fall within the scope of the present invention and therefore the present invention should not be limited by the described embodiments, variations, and applications.

The invention claimed is:

1. A patient support to support a patient, the patient support comprising:

a cover enclosing an interior region, a support positioned in the interior region, the support having at least a head portion, a seat portion, and a foot portion, a control unit operably coupled to the support and positioned outside the interior region, a pneumatic assembly located within the interior region and positioned at the foot section, the pneumatic device including a control box, and a valve block and a control board located in the control box, and a tape switch located within the interior region outside the control box and supported by the control box and being actuatable by a weight of at least a portion of the patient, the switch being coupled to the control unit to send a signal to the control unit upon actuation of the switch.

2. The patient support of claim 1, wherein the pneumatic assembly is located within the interior region adjacent the tape switch.

3. The patient support of claim 1, wherein the tape switch is coupled to the pneumatic assembly.

4. The patient support of claim 3, wherein the pneumatic assembly supports the tape switch.

5. The patient support of claim 4, wherein the pneumatic assembly includes a control board.

6. The patient support of claim 5, wherein the tape switch includes a length substantially supported by the pneumatic assembly.

7. The patient support of claim 6, wherein the tape switch includes a width substantially supported by the pneumatic assembly.

8. The patient support of claim 6, further comprising at least two tape switches coupled together in parallel.

9. The patient support of claim 1, wherein the patient support includes two or more tape switches.

10. The patient support of claim 1, wherein the pressure sensor is located above the control box.

11. The patient support of claim 10, wherein the pressure sensor comprises a plurality of side by side tape switches.

12. The patient support of claim 1, further comprising a housing located outside the interior region of the cover, the housing containing an air pump that is operable to provide pressurized air to the bladder through the valve block.

13. The patient support of claim 12, wherein the air pump is also operable to vacuum air from the bladder through the valve block.

14. The patient support of claim 12, further comprising a user input device coupled to the housing and operable to receive user inputs to control the operation of the patient support.

15. The patient support of claim 12, further comprising a coupler adapted to couple the housing to a portion of a hospital bed.

16. The patient support of claim 15, wherein the coupler comprises hooks configured to permit the housing to be hung on a footboard of the hospital bed.

17. The patient support of claim 1, further comprising an angle sensor to sense an angle of inclination of the head section of the support.

18. A patient support to support a patient, the patient support comprising:

a cover enclosing an interior region, a support having a bladder, the support being positioned in the interior region and having at least a head section and a foot section, a pneumatic device located within the interior region and positioned at the foot section, the pneumatic device including a control box, and a valve block and a control board located in the control box, and a pressure sensor located within the interior region, outside the control box and supported by the control box, the pressure sensor being actuatable by a weight of at least a portion of the patient, the pressure sensor being operably coupled to the control board to send a signal to the control board based on actuation of the pressure sensor.

19. The patient support of claim 18, wherein the pressure sensor is located beneath the bladder.

20. The patient support of claim 19, wherein the pressure sensor is formed of a substantially rigid material.

21. The patient support of claim 20, wherein the pressure sensor comprises a tape switch.

22. The patient support of claim 21, wherein the pressure sensor includes a gold plated electrical lead.

23. The patient support of claim 21, further comprising a plate positioned over at least a portion of the pressure sensor.

24. The patient support of claim 20, wherein the pressure sensor includes at least one sensor pad.

* * * * *